US012252825B2

(12) United States Patent
Liu et al.

(10) Patent No.: US 12,252,825 B2
(45) Date of Patent: Mar. 18, 2025

(54) PATTERN FOR CHENILLE CARPET PILE BASED ON QUATERNARY COLORS MIXING REGULATION OF MULTICOLORED FILAMENTS AND CONSTRUCTION METHOD THEREOF

(71) Applicant: JINHUA JIELING HOUSE WARES CO.,LTD., Jinhua (CN)

(72) Inventors: Qunhao Liu, Jinhua (CN); Shulan Jin, Jinhua (CN)

(73) Assignee: JINHUA JIELING HOUSE WARES CO., LTD., Jinhua (CN)

( * ) Notice: Subject to any disclaimer, the term of this patent is extended or adjusted under 35 U.S.C. 154(b) by 358 days.

(21) Appl. No.: 17/882,641

(22) Filed: Aug. 8, 2022

(65) Prior Publication Data

US 2023/0002947 A1 Jan. 5, 2023

Related U.S. Application Data

(63) Continuation of application No. PCT/CN2021/108348, filed on Jul. 26, 2021.

(30) Foreign Application Priority Data

Jun. 29, 2021 (CN) ..... 202110726887.2

(51) Int. Cl.
*D05C 17/02* (2006.01)
*D06N 7/00* (2006.01)

(52) U.S. Cl.
CPC ..... *D05C 17/026* (2013.01); *D06N 7/0031* (2013.01); *D06N 7/0065* (2013.01)

(58) Field of Classification Search
CPC ... D06N 7/0031; D06N 7/0065; D05C 17/026
See application file for complete search history.

(56) References Cited

U.S. PATENT DOCUMENTS

2008/0041286 A1* 2/2008 Tick ..... D06N 7/0065 112/475.23
2009/0202778 A1 8/2009 McGee
(Continued)

FOREIGN PATENT DOCUMENTS

CN 103076291 A 5/2013
CN 108914292 A 11/2018
(Continued)

*Primary Examiner* — Patrick J. Lynch
(74) *Attorney, Agent, or Firm* — Bayramoglu Law Offices LLC

(57) ABSTRACT

A pattern for a chenille carpet pile based on quaternary colors mixing regulation of multicolored filaments and a construction method thereof are disclosed. The construction method regulates the uneven distribution of the multicolored filaments on the chenille carpet pile by changing the combination modes and ratios of the multicolored filaments, thereby producing patterns with hazy, moderate and clear color mixing effects. Different from the additive mixing of color light and the subtractive mixing of pigments, the mixing of single-colored filaments is spatial juxtaposition mixing and non-uniform mixing. The construction method also regulates the mixing ratio of the single-colored filaments and the hue, luminance and saturation differences between the single-colored filaments, such that the chenille pile can visually present hazy, moderate and clear color mixing effects. The entire design implementation of the construction method can effectively improve the efficiency of constructing the pattern of the chenille carpet pile.

4 Claims, 5 Drawing Sheets

(56) References Cited

U.S. PATENT DOCUMENTS

| | | | | |
|---|---|---|---|---|
| 2017/0073886 | A1* | 3/2017 | Silvers | D02G 3/445 |
| 2022/0112635 | A1* | 4/2022 | Liao | D04B 21/20 |

FOREIGN PATENT DOCUMENTS

| | | | |
|---|---|---|---|
| CN | 110424082 | A | 11/2019 |
| CN | 112562016 | A | 3/2021 |
| CN | 112634387 | A | 4/2021 |
| CN | 112733079 | A | 4/2021 |
| JP | H11256448 | A | 9/1999 |
| JP | 2006241656 | A | 9/2006 |

* cited by examiner

| SN | Patterns | Combinations of piles | Arrangement of piles | Tufting process |
|---|---|---|---|---|
| 1 | 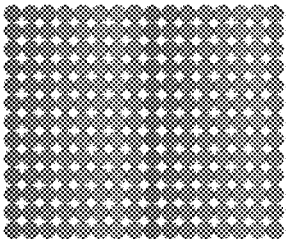 | Column A pile: $3A_1+1A_2+1A_3+1A_4$<br>Column B pile: $2A_1+2A_2+1A_3+1A_4$<br>Column C pile: $1A_1+3A_2+1A_3+1A_4$<br>Column D pile: $1A_1+2A_2+2A_3+1A_4$<br>Column E pile: $1A_1+1A_2+3A_3+1A_4$<br>Column F pile: $1A_1+1A_2+2A_3+2A_4$<br>Column G pile: $1A_1+1A_2+1A_3+3A_4$<br>Column H pile: $2A_1+1A_2+1A_3+2A_4$ | 1A+1B+1C+1D+1E +1F+1G+1H | Straight line tufting |
| 2 | 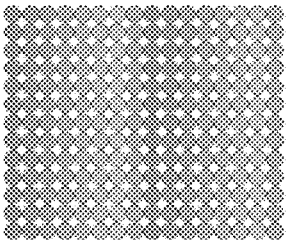 | Column A pile: $3A_2+1A_3+1A_4+1A_5$<br>Column B pile: $2A_2+2A_3+1A_4+1A_5$<br>Column C pile: $1A_2+3A_3+1A_4+1A_5$<br>Column D pile: $1A_2+2A_3+2A_4+1A_5$<br>Column E pile: $1A_2+1A_3+3A_4+1A_5$<br>Column F pile: $1A_2+1A_3+2A_4+2A_5$<br>Column G pile: $1A_2+1A_3+1A_4+3A_5$<br>Column H pile: $2A_2+1A_3+1A_4+2A_5$ | 1A+1B+1C+1D+1E +1F+1G+1H | Straight line tufting |
| 3 | 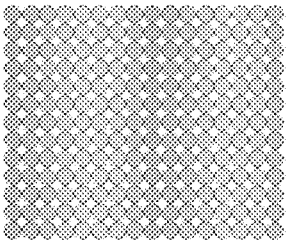 | Column A pile: $3A_3+1A_4+1A_5+1A_6$<br>Column B pile: $2A_3+2A_4+1A_5+1A_6$<br>Column C pile: $1A_3+3A_4+1A_5+1A_6$<br>Column D pile: $1A_3+2A_4+2A_5+1A_6$<br>Column E pile: $1A_3+1A_4+3A_5+1A_6$<br>Column F pile: $1A_3+1A_4+2A_5+2A_6$<br>Column G pile: $1A_3+1A_4+1A_5+3A_6$<br>Column H pile: $2A_3+1A_4+1A_5+2A_6$ | 1A+1B+1C+1D+1E +1F+1G+1H | Straight line tufting |

FIG. 3

| SN | Patterns | Combinations of piles | Arrangement of piles | Tufting process |
|---|---|---|---|---|
| 1 | 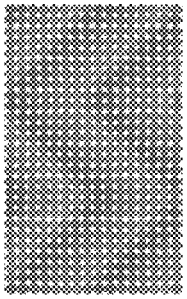 | Column A pile: $3A_1+1A_2+1A_3+1A_9$<br>Column B pile: $2A_1+2A_2+1A_3+1A_9$<br>Column C pile: $1A_1+3A_2+1A_3+1A_9$<br>Column D pile: $1A_1+2A_2+2A_3+1A_9$<br>Column E pile: $1A_1+1A_2+3A_3+1A_9$<br>Column F pile: $1A_1+1A_2+2A_3+2A_9$<br>Column G pile: $1A_1+1A_2+1A_3+3A_9$<br>Column H pile: $2A_1+1A_2+1A_3+2A_9$ | 1A+1B+1C+1D+1E +1F+1G+1H | Move a needle to the left to tuft for 9 stitches, turn to the right from the 10th stitch to tuft for 9 stitches, and repeat the cycle |
| 2 | 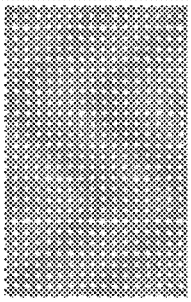 | Column A pile: $3A_2+1A_3+1A_4+1A_{10}$<br>Column B pile: $2A_2+2A_3+1A_4+1A_{10}$<br>Column C pile: $1A_2+3A_3+1A_4+1A_{10}$<br>Column D pile: $1A_2+2A_3+2A_4+1A_{10}$<br>Column E pile: $1A_2+1A_3+3A_4+1A_{10}$<br>Column F pile: $1A_2+1A_3+2A_4+2A_{10}$<br>Column G pile: $1A_2+1A_3+1A_4+3A_{10}$<br>Column H pile: $2A_2+1A_3+1A_4+2A_{10}$ | 1A+1B+1C+1D+1E +1F+1G+1H | Move a needle to the left to tuft for 9 stitches, turn to the right from the 10th stitch to tuft for 9 stitches, and repeat the cycle |
| 3 | 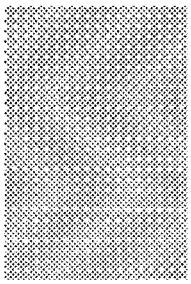 | Column A pile: $3A_3+1A_4+1A_5+1A_{11}$<br>Column B pile: $2A_3+2A_4+1A_5+1A_{11}$<br>Column C pile: $1A_3+3A_4+1A_5+1A_{11}$<br>Column D pile: $1A_3+2A_4+2A_5+1A_{11}$<br>Column E pile: $1A_3+1A_4+3A_5+1A_{11}$<br>Column F pile: $1A_3+1A_4+2A_5+2A_{11}$<br>Column G pile: $1A_3+1A_4+1A_5+3A_{11}$<br>Column H pile: $2A_3+1A_4+1A_5+2A_{11}$ | 1A+1B+1C+1D+1E +1F+1G+1H | Move a needle to the left to tuft for 9 stitches, turn to the right from the 10th stitch to tuft for 9 stitches, and repeat the cycle |

FIG. 4

| SN | Patterns | Combinations of piles | Arrangement of piles | Tufting process |
|---|---|---|---|---|
| 1 | 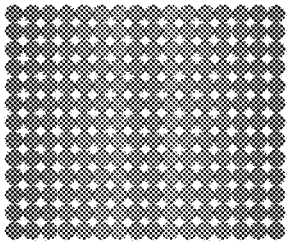 | Column A pile: $3A_1+1A_2+1A_3+1A_{13}$<br>Column B pile: $2A_1+2A_2+1A_3+1A_{13}$<br>Column C pile: $1A_1+3A_2+1A_3+1A_{13}$<br>Column D pile: $1A_1+2A_2+2A_3+1A_{13}$<br>Column E pile: $1A_1+1A_2+3A_3+1A_{13}$<br>Column F pile: $1A_1+1A_2+2A_3+2A_{13}$<br>Column G pile: $1A_1+1A_2+1A_3+3A_{13}$<br>Column H pile: $2A_1+1A_2+1A_3+2A_{13}$ | 1A+1B+1C+1D<br>+1E+1F+1G+1H<br>+1H+1G+1F+1E<br>+1D+1C+1B+1A | Straight line tufting |
| 2 | 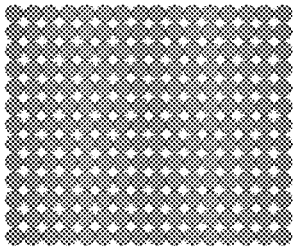 | Column A pile: $3A_2+1A_3+1A_4+1A_{14}$<br>Column B pile: $2A_2+2A_3+1A_4+1A_{14}$<br>Column C pile: $1A_2+3A_3+1A_4+1A_{14}$<br>Column D pile: $1A_2+2A_3+2A_4+1A_{14}$<br>Column E pile: $1A_2+1A_3+3A_4+1A_{14}$<br>Column F pile: $1A_2+1A_3+2A_4+2A_{14}$<br>Column G pile: $1A_2+1A_3+1A_4+3A_{14}$<br>Column H pile: $2A_2+1A_3+1A_4+2A_{14}$ | 1A+1B+1C+1D<br>+1E+1F+1G+1H<br>+1H+1G+1F+1E<br>+1D+1C+1B+1A | Straight line tufting |
| 3 | 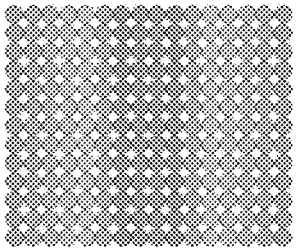 | Column A pile: $3A_3+1A_4+1A_5+1A_{15}$<br>Column B pile: $2A_3+2A_4+1A_5+1A_{15}$<br>Column C pile: $1A_3+3A_4+1A_5+1A_{15}$<br>Column D pile: $1A_3+2A_4+2A_5+1A_{15}$<br>Column E pile: $1A_3+1A_4+3A_5+1A_{15}$<br>Column F pile: $1A_3+1A_4+2A_5+2A_{15}$<br>Column G pile: $1A_3+1A_4+1A_5+3A_{15}$<br>Column H pile: $2A_3+1A_4+1A_5+2A_{15}$ | 1A+1B+1C+1D<br>+1E+1F+1G+1H<br>+1H+1G+1F+1E<br>+1D+1C+1B+1A | Straight line tufting |

FIG. 5

PATTERN FOR CHENILLE CARPET PILE BASED ON QUATERNARY COLORS MIXING REGULATION OF MULTICOLORED FILAMENTS AND CONSTRUCTION METHOD THEREOF

CROSS REFERENCE TO THE RELATED APPLICATIONS

This application is a continuation application of International Application No. PCT/CN2021/108348, filed on Jul. 26, 2021, which is based upon and claims priority to Chinese Patent Application No. 202110726887.2, filed on Jun. 29, 2021, the entire contents of which are incorporated herein by reference.

TECHNICAL FIELD

The present disclosure relates to a pattern for a chenille carpet pile based on quaternary colors mixing regulation of multicolored filaments and a construction method thereof, and belongs to the technical field of spinning chromatography.

BACKGROUND

A chenille carpet of a specific specification is fabricated by dyeing and after-finishing a tufted fabric formed by tufting a chenille yarn on a backing fabric, then gluing and fixing the tufted fabric to a carpet substrate, cutting, binding and sewing.

In the prior art, the chenille yarn is usually fabricated by spinning conventional low-stretch polyester filaments on a chenille spinning machine, the chenille yarn is tufted by a tufting loom to form a tufted fabric, and then the tufted fabric is subjected to high-temperature and high-pressure dyeing so as to dye the pile. After the dyeing, the tufted fabric is glued to the carpet substrate, and then the carpet substrate with the tufted fabric is cut, bound and sewn to form a chenille carpet of a specific specification.

In the dyeing process, the pile is subjected to high-temperature disperse dyeing to achieve an expected color, and the pile is subjected to shrinkage and untwisting which are controlled through the high-temperature heat treatment to make the pile standing, full and soft. The appearance color, feel and style of the chenille carpet depend on those of the pile. Therefore, the dyeing, after-finishing and treating process of the pile is the key process for the fabrication of the chenille carpet.

The dyeing and after-finishing process of the chenille carpet requires a large amount of dyes, energy and water, and also discharges a large amount of sewage. In order to solve the problems of environmental pollution and energy consumption existing in the traditional dyeing process, it is urgent to realize waterless dyeing, precise toning and digital color blending of piles, so as to promote the rapid development of chenille carpets. In view of this, the following problems need to be solved.

1. In the prior art, by changing the dyeing formula, the fabricate(chenille carpet piles can present serialized colors with different hue, luminance and saturation, but there are problems such as low color reproduction, large color difference in different batches and long production cycle.

2. In the prior art, the chenille carpet piles can be fabricated with patterns of different contrasts through overdyeing of two analogous colors. However, there is no report on patterning with hazy, moderate and clear color mixing effects based on color differences, and there are still problems such as low color reproduction, large color difference in different batches and long production cycle.

SUMMARY

A technical problem to be solved by the present disclosure is to provide a pattern for a chenille carpet pile based on quaternary colors mixing regulation of multicolored filaments and a construction method thereof. The present disclosure regulates the uneven distribution of multicolored filaments on a chenille carpet pile by changing the combination modes and ratios of the multicolored filaments, thereby producing patterns with hazy, moderate and clear color mixing effects.

In order to solve the above technical problem, the present disclosure adopts the following technical solution: a pattern for a chenille carpet pile based on quaternary colors mixing regulation of multicolored filaments and a construction method thereof, including the following steps:

step A: constructing a quaternary multicolored filament system by mixing four types of single-colored filaments selected from a preset number of single-colored filaments to form multicolored filaments; and proceeding to step B;

step B: spinning and tufting any four types of multicolored filaments $\alpha,\beta,\gamma,\delta$ in the quaternary multicolored filament system to obtain a chenille carpet pile $\xi$; calculating, based on red, green and blue (RGB) values $(R_\alpha,G_\alpha,B_\alpha)$, $(R_\beta,G_\beta,B_\beta)$, $(R_\gamma,G_\gamma,B_\gamma)$ and $(R_\delta,G_\delta,B_\delta)$ of the four types of multicolored filaments $\alpha,\beta,\gamma,\delta$, RGB values $(R_\xi,G_\xi,B_\xi)$ of the chenille carpet pile $\xi$ corresponding to specified numbers of tufted multicolored filaments; and proceeding to step C; and step C: selecting combinations of the four types of single-colored filaments with preset hue differences from the preset number of single-colored filaments to form multiple types of multicolored filaments with the preset hue differences; and according to the RGB values $(R_\xi,G_\xi,B_\xi)$ of the chenille carpet pile $\xi$ corresponding to specified numbers of tufted multicolored filaments, spinning and tufting four types of multicolored filaments selected based on the multiple types of multicolored filaments with the preset hue differences to respectively construct preset types of chenille carpet piles.

In a preferred technical solution of the present disclosure, step B may include: based on Table 1,

TABLE 1

| | RGB values after combination | | |
|---|---|---|---|
| Combinations | $R_\xi$ | $G_\xi$ | $R_\xi$ |
| $4\alpha$ | $R_\alpha$ | $G_\alpha$ | $B_\alpha$ |
| $3\alpha + 1\beta$ | $\frac{3}{4}*R_\alpha+\frac{1}{4}*R_\beta$ | $\frac{3}{4}*G_\alpha+\frac{1}{4}*G_\beta$ | $\frac{3}{4}*B_\alpha+\frac{1}{4}*B_\beta$ |

TABLE 1-continued

| Combinations | RGB values after combination | | |
|---|---|---|---|
| | $R_\xi$ | $G_\xi$ | $R_\xi$ |
| $2\alpha + 1\beta + 1\gamma$ | $\frac{2}{4}*R_\alpha + \frac{1}{4}*R_\beta + \frac{1}{4}*R_\gamma$ | $\frac{2}{4}*G_\alpha + \frac{1}{4}*G_\beta + \frac{1}{4}*G_\gamma$ | $\frac{2}{4}*B_\alpha + \frac{1}{4}*B_\beta + \frac{1}{4}*B_\gamma$ |
| $1\alpha + 1\beta + 1\gamma + 1\delta$ | $\frac{1}{4}*R_\alpha + \frac{1}{4}*R_\beta + \frac{1}{4}*R_\gamma + \frac{1}{4}*R_\delta$ | $\frac{1}{4}*G_\alpha + \frac{1}{4}*G_\beta + \frac{1}{4}*G_\gamma + \frac{1}{4}*G_\delta$ | $\frac{1}{4}*B_\alpha + \frac{1}{4}*B_\beta + \frac{1}{4}*B_\gamma + \frac{1}{4}*B_\delta$ |
| $2\beta + 1\gamma + 1\delta$ | $\frac{2}{4}*R_\beta + \frac{1}{4}*R_\gamma + \frac{1}{4}*R_\delta$ | $\frac{2}{4}*G_\beta + \frac{1}{4}*G_\gamma + \frac{1}{4}*G_\delta$ | $\frac{2}{4}*B_\beta + \frac{1}{4}*B_\gamma + \frac{1}{4}*B_\delta$ |
| $3\beta + 1\gamma$ | $\frac{3}{4}*R_\beta + \frac{1}{4}*R_\gamma$ | $\frac{3}{4}*G_\beta + \frac{1}{4}*G_\gamma$ | $\frac{3}{4}*B_\beta + \frac{1}{4}*B_\gamma$ |
| $4\beta$ | $R_\beta$ | $G_\beta$ | $B_\beta$ |
| $1\alpha + 1\beta + 1\gamma + 1\delta$ | $\frac{1}{4}*R_\alpha + \frac{1}{4}*R_\beta + \frac{1}{4}*R_\gamma + \frac{1}{4}*R_\delta$ | $\frac{1}{4}*G_\alpha + \frac{1}{4}*G_\beta + \frac{1}{4}*G_\gamma + \frac{1}{4}*G_\delta$ | $\frac{1}{4}*B_\alpha + \frac{1}{4}*B_\beta + \frac{1}{4}*B_\gamma + \frac{1}{4}*B_\delta$ |
| $1\beta + 2\gamma + 1\delta$ | $\frac{1}{4}*R_\beta + \frac{2}{4}*R_\gamma + \frac{1}{4}*R_\delta$ | $\frac{1}{4}*G_\beta + \frac{2}{4}*G_\gamma + \frac{1}{4}*G_\delta$ | $\frac{1}{4}*B_\beta + \frac{2}{4}*B_\gamma + \frac{1}{4}*B_\delta$ |
| $3\gamma + 1\delta$ | $\frac{3}{4}*R_\gamma + \frac{1}{4}*R_\delta$ | $\frac{3}{4}*G_\gamma + \frac{1}{4}*G_\delta$ | $\frac{3}{4}*B_\gamma + \frac{1}{4}*B_\delta$ |
| $4\gamma$ | $R_\gamma$ | $G_\gamma$ | $B_\gamma$ |
| $1\alpha + 2\gamma + 1\delta$ | $\frac{1}{4}*R_\alpha + \frac{2}{4}*R_\gamma + \frac{1}{4}*R_\delta$ | $\frac{1}{4}*G_\alpha + \frac{2}{4}*G_\gamma + \frac{1}{4}*G_\delta$ | $\frac{1}{4}*B_\alpha + \frac{2}{4}*B_\gamma + \frac{1}{4}*B_\delta$ |
| $1\alpha + 1\gamma + 1\delta$ | $\frac{1}{4}*R_\alpha + \frac{1}{4}*R_\gamma + \frac{2}{4}*R_\delta$ | $\frac{1}{4}*G_\alpha + \frac{1}{4}*G_\gamma + \frac{2}{4}*G_\delta$ | $\frac{1}{4}*B_\alpha + \frac{1}{4}*B_\gamma + \frac{2}{4}*B_\delta$ |
| $1\alpha + 3\delta$ | $\frac{1}{4}*R_\alpha + \frac{3}{4}*R_\delta$ | $\frac{1}{4}*G_\alpha + \frac{3}{4}*G_\delta$ | $\frac{1}{4}*B_\alpha + \frac{3}{4}*B_\delta$ |
| $4\delta$ | $R_\delta$ | $G_\delta$ | $B_\delta$ |
| $1\alpha + 1\beta + 2\delta$ | $\frac{1}{4}*R_\alpha + \frac{1}{4}*R_\beta + \frac{2}{4}*R_\delta$ | $\frac{1}{4}*G_\alpha + \frac{1}{4}*G_\beta + \frac{2}{4}*G_\delta$ | $\frac{1}{4}*B_\alpha + \frac{1}{4}*B_\beta + \frac{2}{4}*B_\delta$ |
| $1\alpha + 1\beta + 1\gamma + 1\delta$ | $\frac{1}{4}*R_\alpha + \frac{1}{4}*R_\beta + \frac{1}{4}*R_\gamma + \frac{1}{4}*R_\delta$ | $\frac{1}{4}*G_\alpha + \frac{1}{4}*G_\beta + \frac{1}{4}*G_\gamma + \frac{1}{4}*G_\delta$ | $\frac{1}{4}*B_\alpha + \frac{1}{4}*B_\beta + \frac{1}{4}*B_\gamma + \frac{1}{4}*B_\delta$ |

calculating RGB values ($R_\xi$,$G_\xi$,$B_\xi$) of the chenille carpet pile $\xi$ corresponding to 4 tufted multicolored filaments.

In a preferred technical solution of the present disclosure, step B may include: based on Table 2,

TABLE 2

| Combinations | RGB values after combination | | |
|---|---|---|---|
| | $R_\xi$ | $G_\xi$ | $R_\xi$ |
| $6\alpha$ | $R_\alpha$ | $G_\alpha$ | $B_\alpha$ |
| $5\alpha + 1\beta$ | $\frac{5}{6}*R_\alpha + \frac{1}{6}*R_\beta$ | $\frac{5}{6}*G_\alpha + \frac{1}{6}*G_\beta$ | $\frac{5}{6}*B_\alpha + \frac{1}{6}*B_\beta$ |
| $4\alpha + 1\beta + 1\gamma$ | $\frac{4}{6}*R_\alpha + \frac{1}{6}*R_\beta + \frac{1}{6}*R_\gamma$ | $\frac{4}{6}*G_\alpha + \frac{1}{6}*G_\beta + \frac{1}{6}*G_\gamma$ | $\frac{4}{6}*B_\alpha + \frac{1}{6}*B_\beta + \frac{1}{6}*B_\gamma$ |
| $3\alpha + 1\beta + 1\gamma + 1\delta$ | $\frac{3}{6}*R_\alpha + \frac{1}{6}*R_\beta + \frac{1}{6}*R_\gamma + \frac{1}{6}*R_\delta$ | $\frac{3}{6}*G_\alpha + \frac{1}{6}*G_\beta + \frac{1}{6}*G_\gamma + \frac{1}{6}*G_\delta$ | $\frac{3}{6}*B_\alpha + \frac{1}{6}*B_\beta + \frac{1}{6}*B_\gamma + \frac{1}{6}*B_\delta$ |
| $2\alpha + 2\beta + 1\gamma + 1\delta$ | $\frac{2}{6}*R_\alpha + \frac{2}{6}*R_\beta + \frac{1}{6}*R_\gamma + \frac{1}{6}*R_\delta$ | $\frac{2}{6}*G_\alpha + \frac{2}{6}*G_\beta + \frac{1}{6}*G_\gamma + \frac{1}{6}*G_\delta$ | $\frac{2}{6}*B_\alpha + \frac{2}{6}*B_\beta + \frac{1}{6}*B_\gamma + \frac{1}{6}*B_\delta$ |
| $1\alpha + 3\beta + 1\gamma + 1\delta$ | $\frac{1}{6}*R_\alpha + \frac{3}{6}*R_\beta + \frac{1}{6}*R_\gamma + \frac{1}{6}*R_\delta$ | $\frac{1}{6}*G_\alpha + \frac{3}{6}*G_\beta + \frac{1}{6}*G_\gamma + \frac{1}{6}*G_\delta$ | $\frac{1}{6}*B_\alpha + \frac{3}{6}*B_\beta + \frac{1}{6}*B_\gamma + \frac{1}{6}*B_\delta$ |

TABLE 2-continued

| Combinations | RGB values after combination | | |
|---|---|---|---|
| | $R_\xi$ | $G_\xi$ | $R_\xi$ |
| 4β + 1γ + 1δ | $\frac{4}{6}*R_\beta+\frac{1}{6}*R_\gamma+\frac{1}{6}*R_\delta$ | $\frac{4}{6}*G_\beta+\frac{1}{6}*G_\gamma+\frac{1}{6}*G_\delta$ | $\frac{4}{6}*B_\beta+\frac{1}{6}*B_\gamma+\frac{1}{6}*B_\delta$ |
| 5β + 1γ | $\frac{5}{6}*R_\beta+\frac{1}{6}*R_\gamma$ | $\frac{5}{6}*G_\beta+\frac{1}{6}*G_\gamma$ | $\frac{5}{6}*B_\beta+\frac{1}{6}*B_\gamma$ |
| 6β | $R_\beta$ | $G_\beta$ | $B_\beta$ |
| 1α + 2β + 2γ + 1δ | $\frac{1}{6}*R_\alpha+\frac{2}{6}*R_\beta+\frac{2}{6}*R_\gamma+\frac{1}{6}*R_\delta$ | $\frac{1}{6}*G_\alpha+\frac{2}{6}*G_\beta+\frac{2}{6}*G_\gamma+\frac{1}{6}*G_\delta$ | $\frac{1}{6}*B_\alpha+\frac{2}{6}*B_\beta+\frac{2}{6}*B_\gamma+\frac{1}{6}*B_\delta$ |
| 1α + 1β + 3γ + 1δ | $\frac{1}{6}*R_\alpha+\frac{1}{6}*R_\beta+\frac{3}{6}*R_\gamma+\frac{1}{6}*R_\delta$ | $\frac{1}{6}*G_\alpha+\frac{1}{6}*G_\beta+\frac{3}{6}*G_\gamma+\frac{1}{6}*G_\delta$ | $\frac{1}{6}*B_\alpha+\frac{1}{6}*B_\beta+\frac{3}{6}*B_\gamma+\frac{1}{6}*B_\delta$ |
| 1β + 4γ + 1δ | $\frac{1}{6}*R_\beta+\frac{4}{6}*R_\gamma+\frac{1}{6}*R_\delta$ | $\frac{1}{6}*G_\beta+\frac{4}{6}*G_\gamma+\frac{1}{6}*G_\delta$ | $\frac{1}{6}*B_\beta+\frac{4}{6}*B_\gamma+\frac{1}{6}*B_\delta$ |
| 5γ + 1δ | $\frac{5}{6}*R_\gamma+\frac{1}{6}*R_\delta$ | $\frac{5}{6}*G_\gamma+\frac{1}{6}*G_\delta$ | $\frac{5}{6}*B_\gamma+\frac{1}{6}*B_\delta$ |
| 6γ | $R_\gamma$ | $G_\gamma$ | $B_\gamma$ |
| 1α + 1β + 2γ + 2δ | $\frac{1}{6}*R_\alpha+\frac{1}{6}*R_\beta+\frac{2}{6}*R_\gamma+\frac{2}{6}*R_\delta$ | $\frac{1}{6}*G_\alpha+\frac{1}{6}*G_\beta+\frac{2}{6}*G_\gamma+\frac{2}{6}*G_\delta$ | $\frac{1}{6}*B_\alpha+\frac{1}{6}*B_\beta+\frac{2}{6}*B_\gamma+\frac{2}{6}*B_\delta$ |
| 1α + 1β + 1γ + 3δ | $\frac{1}{6}*R_\alpha+\frac{1}{6}*R_\beta+\frac{1}{6}*R_\gamma+\frac{3}{6}*R_\delta$ | $\frac{1}{6}*G_\alpha+\frac{1}{6}*G_\beta+\frac{1}{6}*G_\gamma+\frac{3}{6}*G_\delta$ | $\frac{1}{6}*B_\alpha+\frac{1}{6}*B_\beta+\frac{1}{6}*B_\gamma+\frac{3}{6}*B_\delta$ |
| 1α + 1β + 4δ | $\frac{1}{6}*R_\alpha+\frac{1}{6}*R_\beta+\frac{4}{6}*R_\delta$ | $\frac{1}{6}*G_\alpha+\frac{1}{6}*G_\beta+\frac{4}{6}*G_\delta$ | $\frac{1}{6}*B_\alpha+\frac{1}{6}*B_\beta+\frac{4}{6}*B_\delta$ |
| 1α + 5δ | $\frac{1}{6}*R_\alpha+\frac{5}{6}*R_\delta$ | $\frac{1}{6}*G_\alpha+\frac{5}{6}*G_\delta$ | $\frac{1}{6}*B_\alpha+\frac{5}{6}*B_\delta$ |
| 6δ | $R_\delta$ | $G_\delta$ | $B_\delta$ |
| 2α + 1β + 1γ + 2δ | $\frac{2}{6}*R_\alpha+\frac{1}{6}*R_\beta+\frac{1}{6}*R_\gamma+\frac{2}{6}*R_\delta$ | $\frac{2}{6}*G_\alpha+\frac{1}{6}*G_\beta+\frac{1}{6}*G_\gamma+\frac{2}{6}*G_\delta$ | $\frac{2}{6}*B_\alpha+\frac{1}{6}*B_\beta+\frac{1}{6}*B_\gamma+\frac{2}{6}*B_\delta$ |

calculating RGB values ($R_\xi$,$G_\xi$,$B_\xi$) of the chenille carpet pile ξ corresponding to 6 tufted multicolored filaments.

In a preferred technical solution of the present disclosure, step B may include: based on Table 3,

TABLE 3

| Combinations | RGB values after combination | | |
|---|---|---|---|
| | $R_\xi$ | $G_\xi$ | $B_\xi$ |
| 8α | $R_\alpha$ | $G_\alpha$ | $B_\alpha$ |
| 7α + 1β | $\frac{7}{8}*R_\alpha+\frac{1}{8}*R_\beta$ | $\frac{7}{8}*G_\alpha+\frac{1}{8}*G_\beta$ | $\frac{7}{8}*B_\alpha+\frac{1}{8}*B_\beta$ |
| 6α + 1β + 1γ | $\frac{6}{8}*R_\alpha+\frac{1}{8}*R_\beta+\frac{1}{8}*R_\gamma$ | $\frac{6}{8}*G_\alpha+\frac{1}{8}*G_\beta+\frac{1}{8}*G_\gamma$ | $\frac{6}{8}*B_\alpha+\frac{1}{8}*B_\beta+\frac{1}{8}*B_\gamma$ |
| 5α + 1β + 1γ + 1δ | $\frac{5}{8}*R_\alpha+\frac{1}{8}*R_\beta+\frac{1}{8}*R_\gamma+\frac{1}{8}*R_\delta$ | $\frac{5}{8}*G_\alpha+\frac{1}{8}*G_\beta+\frac{1}{8}*G_\gamma+\frac{1}{8}*G_\delta$ | $\frac{5}{8}*B_\alpha+\frac{1}{8}*B_\beta+\frac{1}{8}*B_\gamma+\frac{1}{8}*B_\delta$ |
| 4α + 2β + 1γ + 1δ | $\frac{4}{8}*R_\alpha+\frac{2}{8}*R_\beta+\frac{1}{8}*R_\gamma+\frac{1}{8}*R_\delta$ | $\frac{4}{8}*G_\alpha+\frac{2}{8}*G_\beta+\frac{1}{8}*G_\gamma+\frac{1}{8}*G_\delta$ | $\frac{4}{8}*B_\alpha+\frac{2}{8}*B_\beta+\frac{1}{8}*B_\gamma+\frac{1}{8}*B_\delta$ |
| 3α + 3β + 1γ + 1δ | $\frac{3}{8}*R_\alpha+\frac{3}{8}*R_\beta+\frac{1}{8}*R_\gamma+\frac{1}{8}*R_\delta$ | $\frac{3}{8}*G_\alpha+\frac{3}{8}*G_\beta+\frac{1}{8}*G_\gamma+\frac{1}{8}*G_\delta$ | $\frac{3}{8}*B_\alpha+\frac{3}{8}*B_\beta+\frac{1}{8}*B_\gamma+\frac{1}{8}*B_\delta$ |
| 2α + 4β + 1γ + 1δ | $\frac{2}{8}*R_\alpha+\frac{4}{8}*R_\beta+\frac{1}{8}*R_\gamma+\frac{1}{8}*R_\delta$ | $\frac{2}{8}*G_\alpha+\frac{4}{8}*G_\beta+\frac{1}{8}*G_\gamma+\frac{1}{8}*G_\delta$ | $\frac{2}{8}*B_\alpha+\frac{4}{8}*B_\beta+\frac{1}{8}*B_\gamma+\frac{1}{8}*B_\delta$ |

TABLE 3-continued

| Combinations | RGB values after combination | | |
|---|---|---|---|
| | $R_\xi$ | $G_\xi$ | $B_\xi$ |
| $1\alpha + 5\beta + 1\gamma + 1\delta$ | $\frac{1}{8}*R_\alpha + \frac{5}{8}*R_\beta + \frac{1}{8}*R_\gamma + \frac{1}{8}*R_\delta$ | $\frac{1}{8}*G_\alpha + \frac{5}{8}*G_\beta + \frac{1}{8}*G_\gamma + \frac{1}{8}*G_\delta$ | $\frac{1}{8}*B_\alpha + \frac{5}{8}*B_\beta + \frac{1}{8}*B_\gamma + \frac{1}{8}*B_\delta$ |
| $6\alpha + 1\gamma + 1\delta$ | $\frac{6}{8}*R_\beta + \frac{1}{8}*R_\gamma + \frac{1}{8}*R_\delta$ | $\frac{6}{8}*G_\beta + \frac{1}{8}*G_\gamma + \frac{1}{8}*G_\delta$ | $\frac{6}{8}*B_\beta + \frac{1}{8}*B_\gamma + \frac{1}{8}*B_\delta$ |
| $7\beta + 1\gamma$ | $\frac{7}{8}*R_\beta + \frac{1}{8}*R_\gamma$ | $\frac{7}{8}*G_\beta + \frac{1}{8}*G_\gamma$ | $\frac{7}{8}*B_\beta + \frac{1}{8}*B_\gamma$ |
| $8\beta$ | $R_\beta$ | $G_\beta$ | $B_\beta$ |
| $1\alpha + 4\beta + 2\gamma + 1\delta$ | $\frac{1}{8}*R_\alpha + \frac{4}{8}*R_\beta + \frac{2}{8}*R_\gamma + \frac{1}{8}*R_\delta$ | $\frac{1}{8}*G_\alpha + \frac{4}{8}*G_\beta + \frac{2}{8}*G_\gamma + \frac{1}{8}*G_\delta$ | $\frac{1}{8}*B_\alpha + \frac{4}{8}*B_\beta + \frac{2}{8}*B_\gamma + \frac{1}{8}*B_\delta$ |
| $1\alpha + 3\beta + 3\gamma + 1\delta$ | $\frac{1}{8}*R_\alpha + \frac{3}{8}*R_\beta + \frac{3}{8}*R_\gamma + \frac{1}{8}*R_\delta$ | $\frac{1}{8}*G_\alpha + \frac{3}{8}*G_\beta + \frac{3}{8}*G_\gamma + \frac{1}{8}*G_\delta$ | $\frac{1}{8}*B_\alpha + \frac{3}{8}*B_\beta + \frac{3}{8}*B_\gamma + \frac{1}{8}*B_\delta$ |
| $1\alpha + 2\beta + 4\gamma + 1\delta$ | $\frac{1}{8}*R_\alpha + \frac{2}{8}*R_\beta + \frac{4}{8}*R_\gamma + \frac{1}{8}*R_\delta$ | $\frac{1}{8}*G_\alpha + \frac{2}{8}*G_\beta + \frac{4}{8}*G_\gamma + \frac{1}{8}*G_\delta$ | $\frac{1}{8}*B_\alpha + \frac{2}{8}*B_\beta + \frac{4}{8}*B_\gamma + \frac{1}{8}*B_\delta$ |
| $1\alpha + 1\beta + 5\gamma + 1\delta$ | $\frac{1}{8}*R_\alpha + \frac{1}{8}*R_\beta + \frac{5}{8}*R_\gamma + \frac{1}{8}*R_\delta$ | $\frac{1}{8}*G_\alpha + \frac{1}{8}*G_\beta + \frac{5}{8}*G_\gamma + \frac{1}{8}*G_\delta$ | $\frac{1}{8}*B_\alpha + \frac{1}{8}*B_\beta + \frac{5}{8}*B_\gamma + \frac{1}{8}*B_\delta$ |
| $1\beta + 6\gamma + 1\delta$ | $\frac{1}{8}*R_\beta + \frac{6}{8}*R_\gamma + \frac{1}{8}*R_\delta$ | $\frac{1}{8}*G_\beta + \frac{6}{8}*G_\gamma + \frac{1}{8}*G_\delta$ | $\frac{1}{8}*B_\beta + \frac{6}{8}*B_\gamma + \frac{1}{8}*B_\delta$ |
| $7\gamma + 1\delta$ | $\frac{7}{8}*R_\gamma + \frac{1}{8}*R_\delta$ | $\frac{7}{8}*G_\gamma + \frac{1}{8}*G_\delta$ | $\frac{7}{8}*B_\gamma + \frac{1}{8}*B_\delta$ |
| $8\gamma$ | $R_\gamma$ | $G_\gamma$ | $B_\gamma$ |
| $1\alpha + 1\beta + 4\gamma + 2\delta$ | $\frac{1}{8}*R_\alpha + \frac{1}{8}*R_\beta + \frac{4}{8}*R_\gamma + \frac{2}{8}*R_\delta$ | $\frac{1}{8}*G_\alpha + \frac{1}{8}*G_\beta + \frac{4}{8}*G_\gamma + \frac{2}{8}*G_\delta$ | $\frac{1}{8}*B_\alpha + \frac{1}{8}*B_\beta + \frac{4}{8}*B_\gamma + \frac{2}{8}*B_\delta$ |
| $1\alpha + 1\beta + 3\gamma + 3\delta$ | $\frac{1}{8}*R_\alpha + \frac{1}{8}*R_\beta + \frac{3}{8}*R_\gamma + \frac{3}{8}*R_\delta$ | $\frac{1}{8}*G_\alpha + \frac{1}{8}*G_\beta + \frac{3}{8}*G_\gamma + \frac{3}{8}*G_\delta$ | $\frac{1}{8}*B_\alpha + \frac{1}{8}*B_\beta + \frac{3}{8}*B_\gamma + \frac{3}{8}*B_\delta$ |
| $1\alpha + 1\beta + 2\gamma + 4\delta$ | $\frac{1}{8}*R_\alpha + \frac{1}{8}*R_\beta + \frac{2}{8}*R_\gamma + \frac{4}{8}*R_\delta$ | $\frac{1}{8}*G_\alpha + \frac{1}{8}*G_\beta + \frac{2}{8}*G_\gamma + \frac{4}{8}*G_\delta$ | $\frac{1}{8}*B_\alpha + \frac{1}{8}*B_\beta + \frac{2}{8}*B_\gamma + \frac{4}{8}*B_\delta$ |
| $1\alpha + 1\beta + 1\gamma + 5\delta$ | $\frac{1}{8}*R_\alpha + \frac{1}{8}*R_\beta + \frac{1}{8}*R_\gamma + \frac{5}{8}*R_\delta$ | $\frac{1}{8}*G_\alpha + \frac{1}{8}*G_\beta + \frac{1}{8}*G_\gamma + \frac{5}{8}*G_\delta$ | $\frac{1}{8}*B_\alpha + \frac{1}{8}*B_\beta + \frac{1}{8}*B_\gamma + \frac{5}{8}*B_\delta$ |
| $1\alpha + 1\beta + 6\delta$ | $\frac{1}{8}*R_\alpha + \frac{1}{8}*R_\beta + \frac{6}{8}*R_\delta$ | $\frac{1}{8}*G_\alpha + \frac{1}{8}*G_\beta + \frac{6}{8}*G_\delta$ | $\frac{1}{8}*B_\alpha + \frac{1}{8}*B_\beta + \frac{6}{8}*B_\delta$ |
| $1\alpha + 7\delta$ | $\frac{1}{8}*R_\alpha + \frac{7}{8}*R_\delta$ | $\frac{1}{8}*G_\alpha + \frac{7}{8}*G_\delta$ | $\frac{1}{8}*B_\alpha + \frac{7}{8}*B_\delta$ |
| $1\alpha + 1\beta + 5\gamma + 1\delta$ | $R_\delta$ | $G_\delta$ | $B_\delta$ |
| $2\alpha + 1\beta + 1\gamma + 4\delta$ | $\frac{2}{8}*R_\alpha + \frac{1}{8}*R_\beta + \frac{1}{8}*R_\gamma + \frac{4}{8}*R_\delta$ | $\frac{2}{8}*G_\alpha + \frac{1}{8}*G_\beta + \frac{1}{8}*G_\gamma + \frac{4}{8}*G_\delta$ | $\frac{2}{8}*B_\alpha + \frac{1}{8}*B_\beta + \frac{1}{8}*B_\gamma + \frac{4}{8}*B_\delta$ |
| $3\alpha + 1\beta + 1\gamma + 3\delta$ | $\frac{3}{8}*R_\alpha + \frac{1}{8}*R_\beta + \frac{1}{8}*R_\gamma + \frac{3}{8}*R_\delta$ | $\frac{3}{8}*G_\alpha + \frac{1}{8}*G_\beta + \frac{1}{8}*G_\gamma + \frac{3}{8}*G_\delta$ | $\frac{3}{8}*B_\alpha + \frac{1}{8}*B_\beta + \frac{1}{8}*B_\gamma + \frac{3}{8}*B_\delta$ |
| $4\alpha + 1\beta + 1\gamma + 2\delta$ | $\frac{4}{8}*R_\alpha + \frac{1}{8}*R_\beta + \frac{1}{8}*R_\gamma + \frac{2}{8}*R_\delta$ | $\frac{4}{8}*G_\alpha + \frac{1}{8}*G_\beta + \frac{1}{8}*G_\gamma + \frac{2}{8}*G_\delta$ | $\frac{4}{8}*B_\alpha + \frac{1}{8}*B_\beta + \frac{1}{8}*B_\gamma + \frac{2}{8}*B_\delta$ |

calculating RGB values ($R_\xi$,$G_\xi$,$B_\xi$) of the chenille carpet pile ξ corresponding to 8 tufted multicolored filaments.

In a preferred technical solution of the present disclosure, step C may include: selecting combinations of four types of single-colored filaments with a hue difference of less than 60° from the preset number of single-colored filaments to form multiple types of multicolored filaments with a hue difference of less than 60°; and according to the RGB values ($R_\xi$,$G_\xi$,$B_\xi$) of the chenille carpet pile ξ corresponding to a specified number of tufted multicolored filaments, spinning and tufting four types of multicolored filaments based on the multiple types of multicolored filaments with a hue difference of less than 60° to construct a chenille carpet pile with a hazy color mixing effect.

In a preferred technical solution of the present disclosure, step C may include: selecting combinations of four types of single-colored filaments with a hue difference of greater than 60° and less than 120° from the preset number of single-colored filaments to form multiple types of multicolored filaments with a hue difference of greater than 60° and less than 120°; and according to the RGB values ($R_\xi$,$G_\xi$,$B_\xi$) the chenille carpet pile ξ corresponding to a specified number of tufted multicolored filaments, spinning and tufting four types of multicolored filaments based on the multiple types of multicolored filaments with a hue difference of greater than 60° and less than 120° to construct a chenille carpet pile with a moderate color mixing effect.

In a preferred technical solution of the present disclosure, step C may include: selecting combinations of four types of single-colored filaments with a hue difference of greater than 120° and less than 180° from the preset number of single-colored filaments, and selecting combinations of three types of single-colored filaments with a hue difference of greater than 120° and less than 180° from the preset number of single-colored filaments to cooperate with a white or black filament to form combinations of four types of single-colored filaments; forming multiple types of multicolored filaments with a hue difference of greater than 120° and less than 180°; and according to the RGB values ($R_\xi$,$G_\xi$,$B_\xi$) of the chenille carpet pile corresponding to a specified number of tufted multicolored filaments, spinning and tufting four types of multicolored filaments based on the multiple types of multicolored filaments with a hue difference of greater than 120° and less than 180° to construct a chenille carpet pile with a clear color mixing effect.

Compared with the prior art, the above technical solutions of the present disclosure have the following technical effects:

The present disclosure regulates the uneven distribution of the multicolored filaments on the chenille carpet pile by changing the combination modes and ratios of the multicolored filaments, thereby producing patterns with hazy, moderate and clear color mixing effects. Different from the additive mixing of color light and the subtractive mixing of pigments, the mixing of single-colored filaments is spatial juxtaposition mixing and non-uniform mixing. The present disclosure regulates the mixing ratio of the single-colored filaments and the hue, luminance and saturation differences between the single-colored filaments, such that the chenille pile can visually present hazy, moderate and clear color mixing effects. The entire design implementation of the present disclosure can effectively improve the efficiency of constructing the pattern of the chenille carpet pile.

BRIEF DESCRIPTION OF THE DRAWINGS

FIG. 3 shows the practical application of the embodiment with a hazy color mixing effect.

FIG. 4 shows a practical application of the embodiment with a moderate color mixing effect.

FIG. 5 shows a practical application of the embodiment with a clear color mixing effect.

DETAILED DESCRIPTION OF THE EMBODIMENTS

The specific implementation of the present disclosure is further described in detail below with reference to the drawings.

Figure 1:
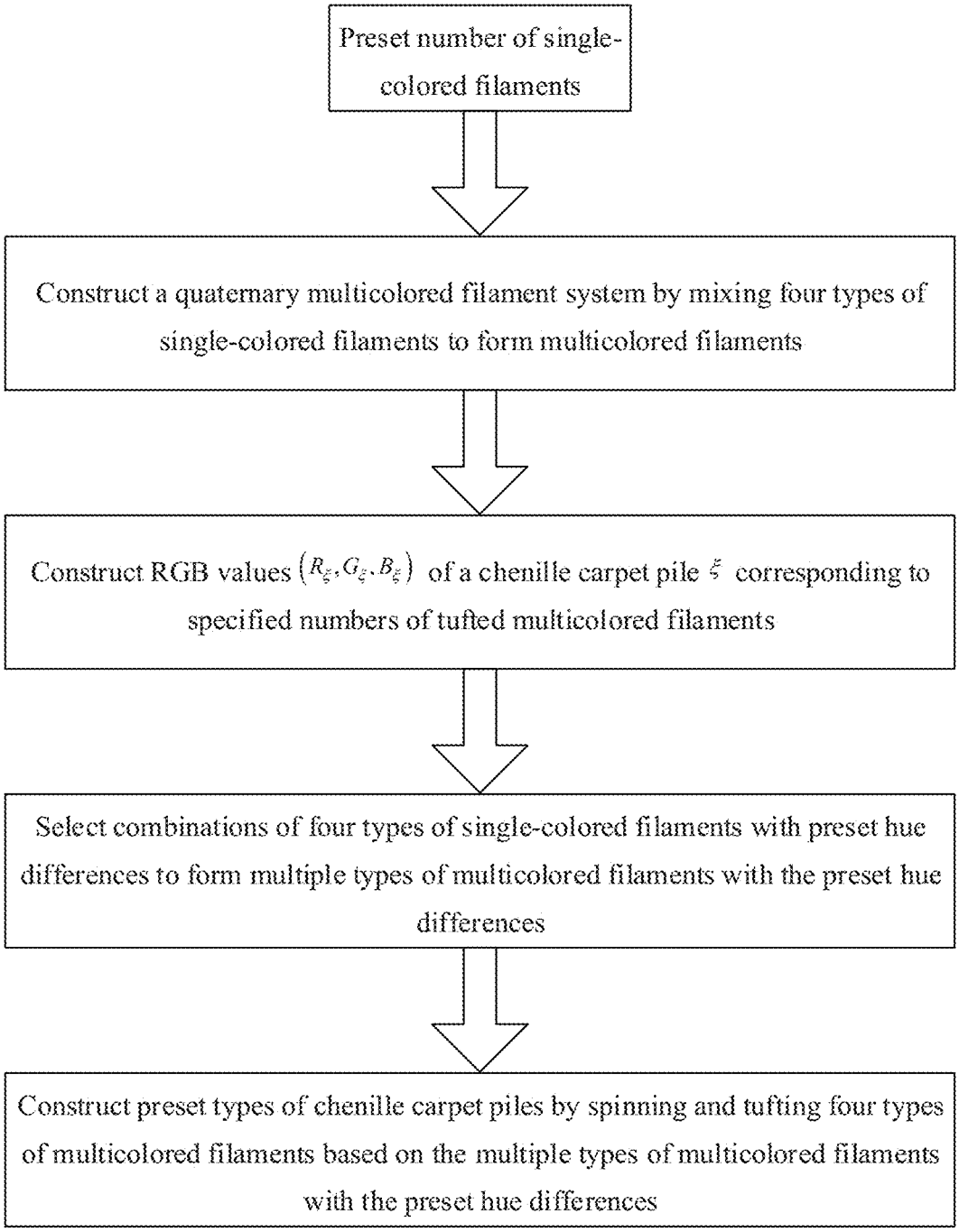
FIG. 1 is a flowchart of a pattern for a chenille carpet pile based on quaternary colors mixing regulation of multicolored filaments and a construction method thereof according to the present disclosure.

The present disclosure proposes a pattern for a chenille carpet pile based on quaternary colors mixing regulation of multicolored filaments and a construction method thereof. In a practical application, as shown in FIG. 1, the method specifically includes Steps A to C.

Step A. Construct a quaternary multicolored filament system by mixing four types of single-colored filaments selected from a preset number of single-colored filaments to form multicolored filaments; and proceed to Step B.

Figure 2:
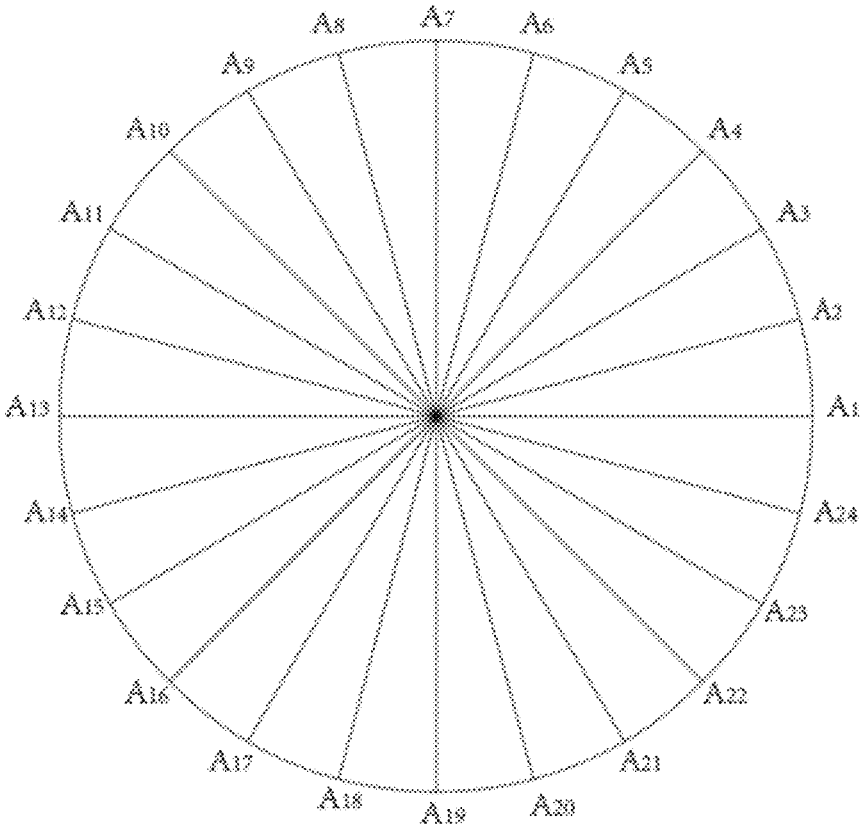
FIG. 2 is a schematic diagram of distribution of 24 base colors.

In a practical application, as shown in FIG. 2, for example, there are a total of 26 base colors obtained by bobbin dyeing or dope dyeing, including $A_1$, $A_2$, $A_3$, . . . $A_{22}$, $A_{23}$ , $A_{24}$ ,W (white) and K (black), and the red, green and blue (RGB) values of each of the base colors are shown in Table 7.

TABLE 7

| | | | |
|---|---|---|---|
| A1(255, 0, 0) | A2(255, 64, 0) | A3(255, 128, 0) | A4(255, 191, 0) |
| A5(255, 255, 0) | A6(191, 255, 0) | A7(128, 255, 0) | A8(64, 255, 0) |
| A9(0, 255, 0) | A10(0, 255, 64) | A11(0, 255, 128) | A12(0, 255, 191) |
| A13(0, 255, 255) | A14(0, 191, 255) | A15(0, 128, 255) | A16(0, 64, 255) |
| A17(0, 0, 255) | A18(64, 0, 255) | A19(128, 0, 255) | A20(191, 0, 255) |
| A21(255, 0, 255) | A22(255, 0, 191) | A23(255, 0, 128) | A24(255, 0, 64) |

By mixing three types of single-colored filaments selected from the 26 types of single-colored filaments according to Step A, a total of $C_{26}^4$ =14950 combinations of four types of single-colored filaments are obtained to form a quaternary multicolored filament system.

Step B. Spin and tuft any four types of multicolored filaments α,β,γ,δ in the quaternary multicolored filament system to obtain a chenille carpet pile ξ; construct, based on RGB values ($R_\alpha$,$G_\alpha$,$B_\alpha$) , ($R_\beta$,$G_\beta$,$B_\beta$), ($R_\gamma$,$G_\gamma$,$B_\gamma$) and ($R_\delta$, $G_\delta$,$B_\delta$) of the four types of multicolored filaments α,β,γ,δ, RGB values ($R_\xi$,$G_\xi$,$B_\xi$) of the chenille carpet pile ξ corresponding to specified numbers of tufted multicolored filaments; and proceed to Step C.

In a specific practical application of Step B, for example, the RGB values ($R_\xi$,$G_\xi$,$B_\xi$) of the chenille carpet pile ξ are constructed corresponding to 4, 6 and 8 tufted multicolored filaments, as shown in Table 1.

TABLE 1

| | RGB values after combination | | |
|---|---|---|---|
| Combinations | $R_\xi$ | $G_\xi$ | $B_\xi$ |
| 4α | $R_\alpha$ | $G_\alpha$ | $B_\alpha$ |
| 3α + 1β | $\frac{3}{4}*R_\alpha+\frac{1}{4}*R_\beta$ | $\frac{3}{4}*G_\alpha+\frac{1}{4}*G_\beta$ | $\frac{3}{4}*B_\alpha+\frac{1}{4}*B_\beta$ |

TABLE 1-continued

| Combinations | RGB values after combination | | |
|---|---|---|---|
| | $R_\xi$ | $G_\xi$ | $B_\xi$ |
| 2α + 1β + 1γ | $\frac{2}{4}*R_\alpha+\frac{1}{4}*R_\beta+\frac{1}{4}*R_\gamma$ | $\frac{2}{4}*G_\alpha+\frac{1}{4}*G_\beta+\frac{1}{4}*G_\gamma$ | $\frac{2}{4}*B_\alpha+\frac{1}{4}*B_\beta+\frac{1}{4}*B_\gamma$ |
| 1α + 1β + 1γ + 1δ | $\frac{1}{4}*R_\alpha+\frac{1}{4}*R_\beta+\frac{1}{4}*R_\gamma+\frac{1}{4}*R_\delta$ | $\frac{1}{4}*G_\alpha+\frac{1}{4}*G_\beta+\frac{1}{4}*G_\gamma+\frac{1}{4}*G_\delta$ | $\frac{1}{4}*B_\alpha+\frac{1}{4}*B_\beta+\frac{1}{4}*B_\gamma+\frac{1}{4}*B_\delta$ |
| 2β + 1γ + 1δ | $\frac{2}{4}*R_\beta+\frac{1}{4}*R_\gamma+\frac{1}{4}*R_\delta$ | $\frac{2}{4}*G_\beta+\frac{1}{4}*G_\gamma+\frac{1}{4}*G_\delta$ | $\frac{2}{4}*B_\beta+\frac{1}{4}*B_\gamma+\frac{1}{4}*B_\delta$ |
| 3β + 1γ | $\frac{3}{4}*R_\beta+\frac{1}{4}*R_\gamma$ | $\frac{3}{4}*G_\beta+\frac{1}{4}*G_\gamma$ | $\frac{3}{4}*G_\beta+\frac{1}{4}*G_\gamma$ |
| 4β | $R_\beta$ | $G_\beta$ | $B_\beta$ |
| 3β + 1γ | $\frac{3}{4}*R_\beta+\frac{1}{4}*R_\gamma$ | $\frac{3}{4}*G_\beta+\frac{1}{4}*G_\gamma$ | $\frac{3}{4}*G_\beta+\frac{1}{4}*G_\gamma$ |
| 2β + 1γ + 1δ | $\frac{2}{4}*R_\beta+\frac{1}{4}*R_\gamma+\frac{1}{4}*R_\delta$ | $\frac{2}{4}*G_\beta+\frac{1}{4}*G_\gamma+\frac{1}{4}*G_\delta$ | $\frac{2}{4}*B_\beta+\frac{1}{4}*B_\gamma+\frac{1}{4}*B_\delta$ |
| 1α + 1β + 1γ + 1δ | $\frac{1}{4}*R_\alpha+\frac{1}{4}*R_\beta+\frac{1}{4}*R_\gamma+\frac{1}{4}*R_\delta$ | $\frac{1}{4}*G_\alpha+\frac{1}{4}*G_\beta+\frac{1}{4}*G_\gamma+\frac{1}{4}*G_\delta$ | $\frac{1}{4}*B_\alpha+\frac{1}{4}*B_\beta+\frac{1}{4}*B_\gamma+\frac{1}{4}*B_\delta$ |
| 1β + 2γ + 1δ | $\frac{1}{4}*R_\beta+\frac{2}{4}*R_\gamma+\frac{1}{4}*R_\delta$ | $\frac{1}{4}*G_\beta+\frac{2}{4}*G_\gamma+\frac{1}{4}*G_\delta$ | $\frac{1}{4}*B_\beta+\frac{2}{4}*B_\gamma+\frac{1}{4}*B_\delta$ |
| 3γ + 1δ | $\frac{3}{4}*R_\gamma+\frac{1}{4}*R_\delta$ | $\frac{3}{4}*G_\gamma+\frac{1}{4}*G_\delta$ | $\frac{3}{4}*B_\gamma+\frac{1}{4}*B_\delta$ |
| 4γ | $R_\gamma$ | $G_\gamma$ | $B_\gamma$ |
| 3γ + 1δ | $\frac{3}{4}*R_\gamma+\frac{1}{4}*R_\delta$ | $\frac{3}{4}*G_\gamma+\frac{1}{4}*G_\delta$ | $\frac{3}{4}*B_\gamma+\frac{1}{4}*B_\delta$ |
| 1α + 2γ + 1δ | $\frac{1}{4}*R_\alpha+\frac{2}{4}*R_\gamma+\frac{1}{4}*R_\delta$ | $\frac{1}{4}*G_\alpha+\frac{2}{4}*G_\gamma+\frac{1}{4}*G_\delta$ | $\frac{1}{4}*B_\alpha+\frac{2}{4}*B_\gamma+\frac{1}{4}*B_\delta$ |
| 1α + 1β + 1γ + 1δ | $\frac{1}{4}*R_\alpha+\frac{1}{4}*R_\beta+\frac{1}{4}*R_\gamma+\frac{1}{4}*R_\delta$ | $\frac{1}{4}*G_\alpha+\frac{1}{4}*G_\beta+\frac{1}{4}*G_\gamma+\frac{1}{4}*G_\delta$ | $\frac{1}{4}*B_\alpha+\frac{1}{4}*B_\beta+\frac{1}{4}*B_\gamma+\frac{1}{4}*B_\delta$ |
| 1α + 1γ + 2δ | $\frac{1}{4}*R_\alpha+\frac{1}{4}*R_\gamma+\frac{2}{4}*R_\delta$ | $\frac{1}{4}*G_\alpha+\frac{1}{4}*G_\gamma+\frac{2}{4}*G_\delta$ | $\frac{1}{4}*B_\alpha+\frac{1}{4}*B_\gamma+\frac{2}{4}*B_\delta$ |
| 1α + 3δ | $\frac{1}{4}*R_\alpha+\frac{3}{4}*R_\delta$ | $\frac{1}{4}*G_\alpha+\frac{3}{4}*G_\delta$ | $\frac{1}{4}*B_\alpha+\frac{3}{4}*B_\delta$ |
| 4δ | $R_\delta$ | $G_\delta$ | $B_\delta$ |
| 1α + 3δ | $\frac{1}{4}*R_\alpha+\frac{3}{4}*R_\delta$ | $\frac{1}{4}*G_\alpha+\frac{3}{4}*G_\delta$ | $\frac{1}{4}*B_\alpha+\frac{3}{4}*B_\delta$ |
| 1α + 1β + 2δ | $\frac{1}{4}*R_\alpha+\frac{1}{4}*R_\beta+\frac{2}{4}*R_\delta$ | $\frac{1}{4}*G_\alpha+\frac{1}{4}*G_\beta+\frac{2}{4}*G_\delta$ | $\frac{1}{4}*B_\alpha+\frac{1}{4}*B_\beta+\frac{2}{4}*B_\delta$ |
| 1α + 1β + 1γ + 1δ | $\frac{1}{4}*R_\alpha+\frac{1}{4}*R_\beta+\frac{1}{4}*R_\gamma+\frac{1}{4}*R_\delta$ | $\frac{1}{4}*G_\alpha+\frac{1}{4}*G_\beta+\frac{1}{4}*G_\gamma+\frac{1}{4}*G_\delta$ | $\frac{1}{4}*B_\alpha+\frac{1}{4}*B_\beta+\frac{1}{4}*B_\gamma+\frac{1}{4}*B_\delta$ |
| 2α + 1β + 1δ | $\frac{2}{4}*R_\alpha+\frac{1}{4}*R_\beta+\frac{1}{4}*R_\delta$ | $\frac{2}{4}*G_\alpha+\frac{1}{4}*G_\beta+\frac{1}{4}*G_\delta$ | $\frac{2}{4}*B_\alpha+\frac{1}{4}*B_\beta+\frac{1}{4}*B_\delta$ |
| 3α + 1β | $\frac{3}{4}*R_\alpha+\frac{1}{4}*R_\beta$ | $\frac{3}{4}*G_\alpha+\frac{1}{4}*G_\beta$ | $\frac{3}{4}*B_\alpha+\frac{1}{4}*B_\beta$ |
| 4α | $R_\alpha$ | $G_\alpha$ | $B_\alpha$ |

The RGB values ($R_\xi$,$G_\xi$,$B_\xi$) of the chenille carpet pile ξ are constructed corresponding to 4 tufted multicolored filaments.

A design of the chenille carpet pile ξ corresponding to 6 tufted multicolored filaments is shown in Table 2.

TABLE 2

| Combinations | RGB values after combination | | |
|---|---|---|---|
| | $R_\xi$ | $G_\xi$ | $B_\xi$ |
| 6α | $R_\alpha$ | $G_\alpha$ | $B_\alpha$ |
| 5α + 1β | $\frac{5}{6}*R_\alpha+\frac{1}{6}*R_\beta$ | $\frac{5}{6}*G_\alpha+\frac{1}{6}*G_\beta$ | $\frac{5}{6}*B_\alpha+\frac{1}{6}*B_\beta$ |
| 4α + 1β + 1γ | $\frac{4}{6}*R_\alpha+\frac{1}{6}*R_\beta+\frac{1}{6}*R_\gamma$ | $\frac{4}{6}*G_\alpha+\frac{1}{6}*G_\beta+\frac{1}{6}*G_\gamma$ | $\frac{4}{6}*B_\alpha+\frac{1}{6}*B_\beta+\frac{1}{6}*B_\gamma$ |
| 3α + 1β + 1γ + 1δ | $\frac{3}{6}*R_\alpha+\frac{1}{6}*R_\beta+\frac{1}{6}*R_\gamma+\frac{1}{6}*R_\delta$ | $\frac{3}{6}*G_\alpha+\frac{1}{6}*G_\beta+\frac{1}{6}*G_\gamma+\frac{1}{6}*G_\delta$ | $\frac{3}{6}*B_\alpha+\frac{1}{6}*B_\beta+\frac{1}{6}*B_\gamma+\frac{1}{6}*B_\delta$ |
| 2α + 2β + 1γ + 1δ | $\frac{2}{6}*R_\alpha+\frac{2}{6}*R_\beta+\frac{1}{6}*R_\gamma+\frac{1}{6}*R_\delta$ | $\frac{2}{6}*G_\alpha+\frac{2}{6}*G_\beta+\frac{1}{6}*G_\gamma+\frac{1}{6}*G_\delta$ | $\frac{2}{6}*B_\alpha+\frac{2}{6}*B_\beta+\frac{1}{6}*B_\gamma+\frac{1}{6}*B_\delta$ |
| 1α + 3β + 1γ + 1δ | $\frac{1}{6}*R_\alpha+\frac{3}{6}*R_\beta+\frac{1}{6}*R_\gamma+\frac{1}{6}*R_\delta$ | $\frac{1}{6}*G_\alpha+\frac{3}{6}*G_\beta+\frac{1}{6}*G_\gamma+\frac{1}{6}*G_\delta$ | $\frac{1}{6}*B_\alpha+\frac{3}{6}*B_\beta+\frac{1}{6}*B_\gamma+\frac{1}{6}*B_\delta$ |
| 4β + 1γ + 1δ | $\frac{4}{6}*R_\beta+\frac{1}{6}*R_\gamma+\frac{1}{6}*R_\delta$ | $\frac{4}{6}*G_\beta+\frac{1}{6}*G_\gamma+\frac{1}{6}*G_\delta$ | $\frac{4}{6}*B_\beta+\frac{1}{6}*B_\gamma+\frac{1}{6}*B_\delta$ |
| 5β + 1γ | $\frac{5}{6}*R_\beta+\frac{1}{6}*R_\gamma$ | $\frac{5}{6}*G_\beta+\frac{1}{6}*G_\gamma$ | $\frac{5}{6}*B_\beta+\frac{1}{6}*B_\gamma$ |
| 6β | $R_\beta$ | $G_\beta$ | $B_\beta$ |
| 5β + 1γ | $\frac{5}{6}*R_\beta+\frac{1}{6}*R_\gamma$ | $\frac{5}{6}*G_\beta+\frac{1}{6}*G_\gamma$ | $\frac{5}{6}*B_\beta+\frac{1}{6}*B_\gamma$ |
| 4β + 1γ + 1δ | $\frac{4}{6}*R_\beta+\frac{1}{6}*R_\gamma+\frac{1}{6}*R_\delta$ | $\frac{4}{6}*G_\beta+\frac{1}{6}*G_\gamma+\frac{1}{6}*G_\delta$ | $\frac{4}{6}*B_\beta+\frac{1}{6}*B_\gamma+\frac{1}{6}*B_\delta$ |
| 1α + 3β + 1γ + 1δ | $\frac{1}{6}*R_\alpha+\frac{3}{6}*R_\beta+\frac{1}{6}*R_\gamma+\frac{1}{6}*R_\delta$ | $\frac{1}{6}*G_\alpha+\frac{3}{6}*G_\beta+\frac{1}{6}*G_\gamma+\frac{1}{6}*G_\delta$ | $\frac{1}{6}*B_\alpha+\frac{3}{6}*B_\beta+\frac{1}{6}*B_\gamma+\frac{1}{6}*B_\delta$ |
| 1α + 2β + 2γ + 1δ | $\frac{1}{6}*R_\alpha+\frac{2}{6}*R_\beta+\frac{2}{6}*R_\gamma+\frac{1}{6}*R_\delta$ | $\frac{1}{6}*G_\alpha+\frac{2}{6}*G_\beta+\frac{2}{6}*G_\gamma+\frac{1}{6}*G_\delta$ | $\frac{1}{6}*B_\alpha+\frac{2}{6}*B_\beta+\frac{2}{6}*B_\gamma+\frac{1}{6}*B_\delta$ |
| 1α + 1β + 3γ + 1δ | $\frac{1}{6}*R_\alpha+\frac{1}{6}*R_\beta+\frac{3}{6}*R_\gamma+\frac{1}{6}*R_\delta$ | $\frac{1}{6}*G_\alpha+\frac{1}{6}*G_\beta+\frac{3}{6}*G_\gamma+\frac{1}{6}*G_\delta$ | $\frac{1}{6}*B_\alpha+\frac{1}{6}*B_\beta+\frac{3}{6}*B_\gamma+\frac{1}{6}*B_\delta$ |
| 1β + 4γ + 1δ | $\frac{1}{6}*R_\beta+\frac{4}{6}*R_\gamma+\frac{1}{6}*R_\delta$ | $\frac{1}{6}*G_\beta+\frac{4}{6}*G_\gamma+\frac{1}{6}*G_\delta$ | $\frac{1}{6}*B_\beta+\frac{4}{6}*B_\gamma+\frac{1}{6}*B_\delta$ |
| 5γ + 1δ | $\frac{5}{6}*R_\gamma+\frac{1}{6}*R_\delta$ | $\frac{5}{6}*G_\gamma+\frac{1}{6}*G_\delta$ | $\frac{5}{6}*B_\gamma+\frac{1}{6}*B_\delta$ |
| 6γ | $R_\gamma$ | $G_\gamma$ | $B_\gamma$ |
| 5γ + 1δ | $\frac{5}{6}*R_\gamma+\frac{1}{6}*R_\delta$ | $\frac{5}{6}*G_\gamma+\frac{1}{6}*G_\delta$ | $\frac{5}{6}*B_\gamma+\frac{1}{6}*B_\delta$ |
| 1α + 4γ + 1δ | $\frac{1}{6}*R_\alpha+\frac{4}{6}*R_\gamma+\frac{1}{6}*R_\delta$ | $\frac{1}{6}*G_\alpha+\frac{4}{6}*G_\gamma+\frac{1}{6}*G_\delta$ | $\frac{1}{6}*B_\alpha+\frac{4}{6}*B_\gamma+\frac{1}{6}*B_\delta$ |
| 1α + 1β + 3γ + 1δ | $\frac{1}{6}*R_\alpha+\frac{1}{6}*R_\beta+\frac{3}{6}*R_\gamma+\frac{1}{6}*R_\delta$ | $\frac{1}{6}*G_\alpha+\frac{1}{6}*G_\beta+\frac{3}{6}*G_\gamma+\frac{1}{6}*G_\delta$ | $\frac{1}{6}*B_\alpha+\frac{1}{6}*B_\beta+\frac{3}{6}*B_\gamma+\frac{1}{6}*B_\delta$ |
| 1α + 1β + 2γ + 2δ | $\frac{1}{6}*R_\alpha+\frac{1}{6}*R_\beta+\frac{2}{6}*R_\gamma+\frac{2}{6}*R_\delta$ | $\frac{1}{6}*G_\alpha+\frac{1}{6}*G_\beta+\frac{2}{6}*G_\gamma+\frac{2}{6}*G_\delta$ | $\frac{1}{6}*B_\alpha+\frac{1}{6}*B_\beta+\frac{2}{6}*B_\gamma+\frac{2}{6}*B_\delta$ |
| 1α + 1β + 1γ + 3δ | $\frac{1}{6}*R_\alpha+\frac{1}{6}*R_\beta+\frac{1}{6}*R_\gamma+\frac{3}{6}*R_\delta$ | $\frac{1}{6}*G_\alpha+\frac{1}{6}*G_\beta+\frac{1}{6}*G_\gamma+\frac{3}{6}*G_\delta$ | $\frac{1}{6}*B_\alpha+\frac{1}{6}*B_\beta+\frac{1}{6}*B_\gamma+\frac{3}{6}*B_\delta$ |
| 1α + 1β + 4δ | $\frac{1}{6}*R_\alpha+\frac{1}{6}*R_\beta+\frac{4}{6}*R_\delta$ | $\frac{1}{6}*G_\alpha+\frac{1}{6}*G_\beta+\frac{4}{6}*G_\delta$ | $\frac{1}{6}*B_\alpha+\frac{1}{6}*B_\beta+\frac{4}{6}*B_\delta$ |
| 1α + 5δ | $\frac{1}{6}*R_\alpha+\frac{5}{6}*R_\delta$ | $\frac{1}{6}*G_\alpha+\frac{5}{6}*G_\delta$ | $\frac{1}{6}*B_\alpha+\frac{5}{6}*B_\delta$ |
| 6δ | $R_\delta$ | $G_\delta$ | $B_\delta$ |

TABLE 2-continued

| Combinations | RGB values after combination | | |
|---|---|---|---|
| | $R_\xi$ | $G_\xi$ | $B_\xi$ |
| 1α + 5δ | $\frac{1}{6}*R_\alpha+\frac{5}{6}*R_\delta$ | $\frac{1}{6}*G_\alpha+\frac{5}{6}*G_\delta$ | $\frac{1}{6}*B_\alpha+\frac{5}{6}*B_\delta$ |
| 1α + 1β + 4δ | $\frac{1}{6}*R_\alpha+\frac{1}{6}*R_\beta+\frac{4}{6}*R_\delta$ | $\frac{1}{6}*G_\alpha+\frac{1}{6}*G_\beta+\frac{4}{6}*G_\delta$ | $\frac{1}{6}*B_\alpha+\frac{1}{6}*B_\beta+\frac{4}{6}*B_\delta$ |
| 1α + 1β + 1γ + 3δ | $\frac{1}{6}*R_\alpha+\frac{1}{6}*R_\beta+\frac{1}{6}*R_\gamma+\frac{3}{6}*R_\delta$ | $\frac{1}{6}*G_\alpha+\frac{1}{6}*G_\beta+\frac{1}{6}*G_\gamma+\frac{3}{6}*$ | $\frac{1}{6}*B_\alpha+\frac{1}{6}*B_\beta+\frac{1}{6}*B_\gamma+\frac{3}{6}*$ |
| 2α + 1β + 1γ + 2δ | $\frac{2}{6}*R_\alpha+\frac{1}{6}*R_\beta+\frac{1}{6}*R_\gamma+\frac{2}{6}*R_\delta$ | $\frac{2}{6}*G_\alpha+\frac{1}{6}*G_\beta+\frac{1}{6}*G_\gamma+\frac{2}{6}*G_\delta$ | $\frac{2}{6}*B_\alpha+\frac{1}{6}*B_\beta+\frac{1}{6}*B_\gamma+\frac{2}{6}*B_\delta$ |
| 3α + 1β + 1γ + 1δ | $\frac{3}{6}*R_\alpha+\frac{1}{6}*R_\beta+\frac{1}{6}*R_\gamma+\frac{1}{6}*R_\delta$ | $\frac{3}{6}*G_\alpha+\frac{1}{6}*G_\beta+\frac{1}{6}*G_\gamma+\frac{1}{6}*G_\delta$ | $\frac{3}{6}*B_\alpha+\frac{1}{6}*B_\beta+\frac{1}{6}*B_\gamma+\frac{1}{6}*B_\delta$ |
| 4α + 1β + 1γ | $\frac{4}{6}*R_\alpha+\frac{1}{6}*R_\beta+\frac{1}{6}*R_\gamma$ | $\frac{4}{6}*G_\alpha+\frac{1}{6}*G_\beta+\frac{1}{6}*G_\gamma$ | $\frac{4}{6}*B_\alpha+\frac{1}{6}*B_\beta+\frac{1}{6}*B_\gamma$ |
| 5α + 1β | $\frac{5}{6}*R_\alpha+\frac{1}{6}*R_\beta$ | $\frac{5}{6}*G_\alpha+\frac{1}{6}*G_\beta$ | $\frac{5}{6}*B_\alpha+\frac{1}{6}*B_\beta$ |
| 6α | $R_\alpha$ | $G_\alpha$ | $B_\alpha$ |

The RGB values ($R_\xi$,$G_\xi$,$B_\xi$) of the chenille carpet pile ξ are constructed corresponding to 6 tufted multicolored filaments.

A design of the chenille carpet pile ξ corresponding to 8 tufted multicolored filaments is shown in Table 3.

TABLE 3

| Combinations | RGB values after combination | | |
|---|---|---|---|
| | $R_\xi$ | $G_\xi$ | $B_\xi$ |
| 8α | $R_\alpha$ | $G_\alpha$ | $B_\alpha$ |
| 7α + 1β | $\frac{7}{8}*R_\alpha+\frac{1}{8}*R_\beta$ | $\frac{7}{8}*G_\alpha+\frac{1}{8}*G_\beta$ | $\frac{7}{8}*B_\alpha+\frac{1}{8}*B_\beta$ |
| 6α + 1β + 1γ | $\frac{6}{8}*R_\alpha+\frac{1}{8}*R_\beta+\frac{1}{8}*R_\gamma$ | $\frac{6}{8}*G_\alpha+\frac{1}{8}*G_\beta+\frac{1}{8}*G_\gamma$ | $\frac{6}{8}*B_\alpha+\frac{1}{8}*B_\beta+\frac{1}{8}*B_\gamma$ |
| 5α + 1β + 1γ + 1δ | $\frac{5}{8}*R_\alpha+\frac{1}{8}*R_\beta+\frac{1}{8}*R_\gamma+\frac{1}{8}*R_\delta$ | $\frac{5}{8}*G_\alpha+\frac{1}{8}*G_\beta+\frac{1}{8}*G_\gamma+\frac{1}{8}*G_\delta$ | $\frac{5}{8}*B_\alpha+\frac{1}{8}*B_\beta+\frac{1}{8}*B_\gamma+\frac{1}{8}*B_\delta$ |
| 4α + 2β + 1γ + 1δ | $\frac{4}{8}*R_\alpha+\frac{2}{8}*R_\beta+\frac{1}{8}*R_\gamma+\frac{1}{8}*R_\delta$ | $\frac{4}{8}*G_\alpha+\frac{2}{8}*G_\beta+\frac{1}{8}*G_\gamma+\frac{1}{8}*G_\delta$ | $\frac{4}{8}*B_\alpha+\frac{2}{8}*B_\beta+\frac{1}{8}*B_\gamma+\frac{1}{8}*B_\delta$ |
| 3α + 3β + 1γ + 1δ | $\frac{3}{8}*R_\alpha+\frac{3}{8}*R_\beta+\frac{1}{8}*R_\gamma+\frac{1}{8}*R_\delta$ | $\frac{3}{8}*G_\alpha+\frac{3}{8}*G_\beta+\frac{1}{8}*G_\gamma+\frac{1}{8}*G_\delta$ | $\frac{3}{8}*B_\alpha+\frac{3}{8}*B_\beta+\frac{1}{8}*B_\gamma+\frac{1}{8}*B_\delta$ |
| 2α + 4β + 1γ + 1δ | $\frac{2}{8}*R_\alpha+\frac{4}{8}*R_\beta+\frac{1}{8}*R_\gamma+\frac{1}{8}*R_\delta$ | $\frac{2}{8}*G_\alpha+\frac{4}{8}*G_\beta+\frac{1}{8}*G_\gamma+\frac{1}{8}*G_\delta$ | $\frac{2}{8}*B_\alpha+\frac{4}{8}*B_\beta+\frac{1}{8}*B_\gamma+\frac{1}{8}*B_\delta$ |
| 1α + 5β + 1γ + 1δ | $\frac{1}{8}*R_\alpha+\frac{5}{8}*R_\beta+\frac{1}{8}*R_\gamma+\frac{1}{8}*R_\delta$ | $\frac{1}{8}*G_\alpha+\frac{5}{8}*G_\beta+\frac{1}{8}*G_\gamma+\frac{1}{8}*G_\delta$ | $\frac{1}{8}*B_\alpha+\frac{5}{8}*B_\beta+\frac{1}{8}*B_\gamma+\frac{1}{8}*B_\delta$ |
| 6α + 1γ + 1δ | $\frac{6}{8}*R_\beta+\frac{1}{8}*R_\gamma+\frac{1}{8}*R_\delta$ | $\frac{6}{8}*G_\beta+\frac{1}{8}*G_\gamma+\frac{1}{8}*G_\delta$ | $\frac{6}{8}*B_\beta+\frac{1}{8}*B_\gamma+\frac{1}{8}*B_\delta$ |
| 7β + 1γ | $\frac{7}{8}*R_\beta+\frac{1}{8}*R_\gamma$ | $\frac{7}{8}*G_\beta+\frac{1}{8}*G_\gamma$ | $\frac{7}{8}*B_\beta+\frac{1}{8}*B_\gamma$ |
| 8β | $R_\beta$ | $G_\beta$ | $B_\beta$ |
| 7β + 1γ | $\frac{7}{8}*R_\beta+\frac{1}{8}*R_\gamma$ | $\frac{7}{8}*G_\beta+\frac{1}{8}*G_\gamma$ | $\frac{7}{8}*B_\beta+\frac{1}{8}*B_\gamma$ |

TABLE 3-continued

| Combinations | RGB values after combination | | |
|---|---|---|---|
| | $R_\xi$ | $G_\xi$ | $B_\xi$ |
| 6β + 1γ + 1δ | $\frac{6}{8}*R_\beta+\frac{1}{8}*R_\gamma+\frac{1}{8}*R_\delta$ | $\frac{6}{8}*G_\beta+\frac{1}{8}*G_\gamma+\frac{1}{8}*G_\delta$ | $\frac{6}{8}*B_\beta+\frac{1}{8}*B_\gamma+\frac{1}{8}*B_\delta$ |
| 1α + 5β + 1γ + 1δ | $\frac{1}{8}*R_\alpha+\frac{5}{8}*R_\beta+\frac{1}{8}*R_\gamma+\frac{1}{8}*R_\delta$ | $\frac{1}{8}*G_\alpha+\frac{5}{8}*G_\beta+\frac{1}{8}*G_\gamma+\frac{1}{8}*G_\delta$ | $\frac{1}{8}*B_\alpha+\frac{5}{8}*B_\beta+\frac{1}{8}*B_\gamma+\frac{1}{8}*$ |
| 1α + 4β + 2γ + 1δ | $\frac{1}{8}*R_\alpha+\frac{4}{8}*R_\beta+\frac{2}{8}*R_\gamma+\frac{1}{8}*R_\delta$ | $\frac{1}{8}*G_\alpha+\frac{4}{8}*G_\beta+\frac{2}{8}*G_\gamma+\frac{1}{8}*G_\delta$ | $\frac{1}{8}*B_\alpha+\frac{4}{8}*B_\beta+\frac{2}{8}*B_\gamma+\frac{1}{8}*B_\delta$ |
| 1α + 3β + 3γ + 1δ | $\frac{1}{8}*R_\alpha+\frac{3}{8}*R_\beta+\frac{3}{8}*R_\gamma+\frac{1}{8}*R_\delta$ | $\frac{1}{8}*G_\alpha+\frac{3}{8}*G_\beta+\frac{3}{8}*G_\gamma+\frac{1}{8}*G_\delta$ | $\frac{1}{8}*B_\alpha+\frac{3}{8}*B_\beta+\frac{3}{8}*B_\gamma+\frac{1}{8}*B_\delta$ |
| 1α + 2β + 4γ + 1δ | $\frac{1}{8}*R_\alpha+\frac{2}{8}*R_\beta+\frac{4}{8}*R_\gamma+\frac{1}{8}*R_\delta$ | $\frac{1}{8}*G_\alpha+\frac{2}{8}*G_\beta+\frac{4}{8}*G_\gamma+\frac{1}{8}*G_\delta$ | $\frac{1}{8}*B_\alpha+\frac{2}{8}*B_\beta+\frac{4}{8}*B_\gamma+\frac{1}{8}*B_\delta$ |
| 1α + 1β + 5γ + 1δ | $\frac{1}{8}*R_\alpha+\frac{1}{8}*R_\beta+\frac{5}{8}*R_\gamma+\frac{1}{8}*R_\delta$ | $\frac{1}{8}*G_\alpha+\frac{1}{8}*G_\beta+\frac{5}{8}*G_\gamma+\frac{1}{8}*G_\delta$ | $\frac{1}{8}*B_\alpha+\frac{1}{8}*B_\beta+\frac{5}{8}*B_\gamma+\frac{1}{8}*B_\delta$ |
| 1β + 6γ + 1δ | $\frac{1}{8}*R_\beta+\frac{6}{8}*R_\gamma+\frac{1}{8}*R_\delta$ | $\frac{1}{8}*G_\beta+\frac{6}{8}*G_\gamma+\frac{1}{8}*G_\delta$ | $\frac{1}{8}*B_\beta+\frac{6}{8}*B_\gamma+\frac{1}{8}*B_\delta$ |
| 7γ + 1δ | $\frac{7}{8}*R_\gamma+\frac{1}{8}*R_\delta$ | $\frac{7}{8}*G_\gamma+\frac{1}{8}*G_\delta$ | $\frac{7}{8}*B_\gamma+\frac{1}{8}*B_\delta$ |
| 8γ | $R_\gamma$ | $G_\gamma$ | $B_\gamma$ |
| 7γ + 1δ | $\frac{7}{8}*R_\gamma+\frac{1}{8}*R_\delta$ | $\frac{7}{8}*G_\gamma+\frac{1}{8}*G_\delta$ | $\frac{7}{8}*B_\gamma+\frac{1}{8}*B_\delta$ |
| 1α + 6γ + 1δ | $\frac{1}{8}*R_\alpha+\frac{6}{8}*R_\gamma+\frac{1}{8}*R_\delta$ | $\frac{1}{8}*G_\alpha+\frac{6}{8}*G_\gamma+\frac{1}{8}*G_\delta$ | $\frac{1}{8}*B_\alpha+\frac{6}{8}*B_\gamma+\frac{1}{8}*B_\delta$ |
| 1α + 1β + 5γ + 1δ | $\frac{1}{8}*R_\alpha+\frac{1}{8}*R_\beta+\frac{5}{8}*R_\gamma+\frac{1}{8}*R_\delta$ | $\frac{1}{8}*G_\alpha+\frac{1}{8}*G_\beta+\frac{5}{8}*G_\gamma+\frac{1}{8}*G_\delta$ | $\frac{1}{8}*B_\alpha+\frac{1}{8}*B_\beta+\frac{5}{8}*B_\gamma+\frac{1}{8}*B_\delta$ |
| 1α + 1β + 4γ + 2δ | $\frac{1}{8}*R_\alpha+\frac{1}{8}*R_\beta+\frac{4}{8}*R_\gamma+\frac{2}{8}*R_\delta$ | $\frac{1}{8}*G_\alpha+\frac{1}{8}*G_\beta+\frac{4}{8}*G_\gamma+\frac{2}{8}*G_\delta$ | $\frac{1}{8}*B_\alpha+\frac{1}{8}*B_\beta+\frac{4}{8}*B_\gamma+\frac{2}{8}*B_\delta$ |
| 1α + 1β + 3γ + 3δ | $\frac{1}{8}*R_\alpha+\frac{1}{8}*R_\beta+\frac{3}{8}*R_\gamma+\frac{3}{8}*R_\delta$ | $\frac{1}{8}*G_\alpha+\frac{1}{8}*G_\beta+\frac{3}{8}*G_\gamma+\frac{3}{8}*G_\delta$ | $\frac{1}{8}*B_\alpha+\frac{1}{8}*B_\beta+\frac{3}{8}*B_\gamma+\frac{3}{8}*B_\delta$ |
| 1α + 1β + 2γ + 4δ | $\frac{1}{8}*R_\alpha+\frac{1}{8}*R_\beta+\frac{2}{8}*R_\gamma+\frac{4}{8}*R_\delta$ | $\frac{1}{8}*G_\alpha+\frac{1}{8}*G_\beta+\frac{2}{8}*G_\gamma+\frac{4}{8}*G_\delta$ | $\frac{1}{8}*B_\alpha+\frac{1}{8}*B_\beta+\frac{2}{8}*B_\gamma+\frac{4}{8}*B_\delta$ |
| 1α + 1β + 1γ + 5δ | $\frac{1}{8}*R_\alpha+\frac{1}{8}*R_\beta+\frac{1}{8}*R_\gamma+\frac{5}{8}*R_\delta$ | $\frac{1}{8}*G_\alpha+\frac{1}{8}*G_\beta+\frac{1}{8}*G_\gamma+\frac{5}{8}*G_\delta$ | $\frac{1}{8}*B_\alpha+\frac{1}{8}*B_\beta+\frac{1}{8}*B_\gamma+\frac{5}{8}*B_\delta$ |
| 1α + 1β + 6δ | $\frac{1}{8}*R_\alpha+\frac{1}{8}*R_\beta+\frac{6}{8}*R_\delta$ | $\frac{1}{8}*G_\alpha+\frac{1}{8}*G_\beta+\frac{6}{8}*G_\delta$ | $\frac{1}{8}*B_\alpha+\frac{1}{8}*B_\beta+\frac{6}{8}*B_\delta$ |
| 1α + 7δ | $\frac{1}{8}*R_\alpha+\frac{7}{8}*R_\delta$ | $\frac{1}{8}*G_\alpha+\frac{7}{8}*G_\delta$ | $\frac{1}{8}*B_\alpha+\frac{7}{8}*B_\delta$ |
| 1α + 1β + 5γ + 1δ | $R_\delta$ | $G_\delta$ | $B_\delta$ |
| 1α + 7δ | $\frac{1}{8}*R_\alpha+\frac{7}{8}*R_\delta$ | $\frac{1}{8}*G_\alpha+\frac{7}{8}*G_\delta$ | $\frac{1}{8}*B_\alpha+\frac{7}{8}*B_\delta$ |
| 1α + 1β + 6δ | $\frac{1}{8}*R_\alpha+\frac{1}{8}*R_\beta+\frac{6}{8}*R_\delta$ | $\frac{1}{8}*G_\alpha+\frac{1}{8}*G_\beta+\frac{6}{8}*G_\delta$ | $\frac{1}{8}*B_\alpha+\frac{1}{8}*B_\beta+\frac{6}{8}*B_\delta$ |
| 1α + 1β + 1γ + 5δ | $\frac{1}{8}*R_\alpha+\frac{1}{8}*R_\beta+\frac{1}{8}*R_\gamma+\frac{5}{8}*R_\delta$ | $\frac{1}{8}*G_\alpha+\frac{1}{8}*G_\beta+\frac{1}{8}*G_\gamma+\frac{5}{8}*G_\delta$ | $\frac{1}{8}*B_\alpha+\frac{1}{8}*B_\beta+\frac{1}{8}*B_\gamma+\frac{5}{8}*B_\delta$ |
| 2α + 1β + 1γ + 4δ | $\frac{2}{8}*R_\alpha+\frac{1}{8}*R_\beta+\frac{1}{8}*R_\gamma+\frac{4}{8}*R_\delta$ | $\frac{2}{8}*G_\alpha+\frac{1}{8}*G_\beta+\frac{1}{8}*G_\gamma+\frac{4}{8}*G_\delta$ | $\frac{2}{8}*B_\alpha+\frac{1}{8}*B_\beta+\frac{1}{8}*B_\gamma+\frac{4}{8}*B_\delta$ |

TABLE 3-continued

| Combinations | RGB values after combination | | |
|---|---|---|---|
| | $R_\xi$ | $G_\xi$ | $B_\xi$ |
| $3\alpha + 1\beta + 1\gamma + 3\delta$ | $\frac{3}{8}*R_\alpha + \frac{1}{8}*R_\beta + \frac{1}{8}*R_\gamma + \frac{3}{8}*R_\delta$ | $\frac{3}{8}*G_\alpha + \frac{1}{8}*G_\beta + \frac{1}{8}*G_\gamma + \frac{3}{8}*G_\delta$ | $\frac{3}{8}*B_\alpha + \frac{1}{8}*B_\beta + \frac{1}{8}*B_\gamma + \frac{3}{8}*B_\delta$ |
| $4\alpha + 1\beta + 1\gamma + 2\delta$ | $\frac{4}{8}*R_\alpha + \frac{1}{8}*R_\beta + \frac{1}{8}*R_\gamma + \frac{2}{8}*R_\delta$ | $\frac{4}{8}*G_\alpha + \frac{1}{8}*G_\beta + \frac{1}{8}*G_\gamma + \frac{2}{8}*G_\delta$ | $\frac{4}{8}*B_\alpha + \frac{1}{8}*B_\beta + \frac{1}{8}*B_\gamma + \frac{2}{8}*B_\delta$ |
| $5\alpha + 1\beta + 1\gamma + 1\delta$ | $\frac{5}{8}*R_\alpha + \frac{1}{8}*R_\beta + \frac{1}{8}*R_\gamma + \frac{1}{8}*R_\delta$ | $\frac{5}{8}*G_\alpha + \frac{1}{8}*G_\beta + \frac{1}{8}*G_\gamma + \frac{1}{8}*G_\delta$ | $\frac{5}{8}*B_\alpha + \frac{1}{8}*B_\beta + \frac{1}{8}*B_\gamma + \frac{1}{8}*B_\delta$ |
| $6\alpha + 1\beta + 1\gamma$ | $\frac{6}{8}*R_\alpha + \frac{1}{8}*R_\beta + \frac{1}{8}*R_\gamma$ | $\frac{6}{8}*G_\alpha + \frac{1}{8}*G_\beta + \frac{1}{8}*G_\gamma$ | $\frac{6}{8}*B_\alpha + \frac{1}{8}*B_\beta + \frac{1}{8}*B_\gamma$ |
| $7\alpha + 1\beta$ | $\frac{7}{8}*R_\alpha + \frac{1}{8}*R_\beta$ | $\frac{7}{8}*G_\alpha + \frac{1}{8}*G_\beta$ | $\frac{7}{8}*B_\alpha + \frac{1}{8}*B_\beta$ |
| $8\alpha$ | $R_\alpha$ | $G_\alpha$ | $B_\alpha$ |

The RGB values ($R_\xi$,$G_\xi$,$B_\xi$) of the chenille carpet pile $\xi$ are constructed corresponding to 8 tufted multicolored filaments.

The chenille pile can visually present hazy, moderate and clear color mixing effects. The visually hazy color mixing effect is achieved by mixing fibers of different colors in adjacent color areas. The visually moderate color mixing effect is achieved by mixing fibers of different colors in complementary color areas. The visually clear color mixing effect is achieved by mixing fibers of different colors in opponent color areas.

Step C. Select combinations of the four types of single-colored filaments with preset hue differences from the preset number of single-colored filaments to form multiple types of multicolored filaments with the preset hue differences; and according to the RGB values ($R_\xi$,$G_\xi$,$B_\xi$) of the chenille carpet pile $\xi$ corresponding to specified numbers of tufted multicolored filaments, spin and tuft four types of multicolored filaments selected based on the multiple types of multicolored filaments with the preset hue differences to respectively construct preset types of chenille carpet piles.

Specifically, in Step C, the preset hue differences include a hue difference of less than 60°, a hue difference of greater than 60° and less than 120°, and a hue difference of greater than 120° and less than 180°. In a specific design implementation, when the hue difference is less than 60°, combinations of four types of single-colored filaments with a hue difference of less than 60° are selected from the preset number of single-colored filaments to form multiple types of multicolored filaments with a hue difference of less than 60°. Based on the RGB values ($R_\xi$,$G_\xi$,$B_\xi$) of the chenille carpet pile $\xi$ corresponding to a specified number of tufted multicolored filaments, four types of multicolored filaments are selected from the multiple types of multicolored filaments with a hue difference of less than 60° for tufting to construct a chenille carpet pile with a hazy color mixing effect.

In the method of tufting four types of multicolored filaments, when the chenille carpet pile is prepared by mixing 4 multicolored filaments, a color mixing gradient is ¼. When the chenille carpet pile is prepared by mixing 6 multicolored filaments, the color mixing gradient is ⅙. When the chenille carpet pile is prepared by mixing 8 multicolored filaments, the color mixing gradient is ⅛.

When the hue difference is greater than 60° and less than 120°, combinations of four types of single-colored filaments with a hue difference of greater than 60° and less than 120° are selected from the preset number of single-colored filaments to form multiple types of multicolored filaments with a hue difference of greater than 60° and less than 120.° Based on the RGB values ($R_\xi$,$G_\xi$,$B_\xi$) of the chenille carpet pile $\xi$ corresponding to a specified number of tufted multicolored filaments, four types of multicolored filaments are selected from the multiple types of multicolored filaments with a hue difference of greater than 60° and less than 120° for tufting to construct a chenille carpet pile with a moderate color mixing effect.

In the method of tufting three types of multicolored filaments, when the chenille carpet pile is prepared by mixing 4 multicolored filaments, the color mixing gradient is ¼. When the chenille carpet pile is prepared by mixing 6 multicolored filaments, the color mixing gradient is ⅙. When the chenille carpet pile is prepared by mixing 8 multicolored filaments, the color mixing gradient is ⅛.

When the hue difference is greater than 120° and less than 180°, combinations of four types of single-colored filaments with a hue difference of greater than 120° and less than 180° are selected from the preset number of single-colored filaments, and combinations of three types of single-colored filaments with a hue difference of greater than 120° and less than 180° are selected from the preset number of single-colored filaments to cooperate with a white or black filament to form combinations of four types of single-colored filaments. These combinations of four types of single-colored filaments form multiple types of multicolored filaments with the hue difference. Based on the ($R_\xi$,$G_\xi$,$B_\xi$) of the chenille carpet pile $\xi$ corresponding to a specified number of tufted multicolored filaments, four types of multicolored filaments are selected from the multiple types of multicolored filaments with a hue difference of greater than 120° and less than 180° for tufting to construct a chenille carpet pile with a clear color mixing effect.

In the method of tithing three types of multicolored filaments, when the chenille carpet pile is prepared by mixing 4 multicolored filaments, a color mixing gradient is ¼. When the chenille carpet pile is prepared by mixing 6 multicolored filaments, the color mixing gradient is ⅙. When the chenille carpet pile is prepared by mixing 8 multicolored filaments, the color mixing gradient is ⅛.

FIG. 3 shows the practical application of the construction of the pattern of the chenille carpet pile, the application of the RGB values ($R_\xi$,$G_\xi$,$B_\xi$) of the chenille carpet pile ξ corresponding to 6 tufted multicolored filaments, the application of the 24 single-colored filaments, and the design of gradient patterns of color-mixed chenille carpet piles in an embodiment regarding chenille carpet piles with a gradient change in the hazy color mixing effect.

The RGB values of the chenille carpet pile with a hazy color mixing effect are shown in Table 4.

TABLE 4

| SN | Combinations of colors | | Color mixing ratio | RGB values ($R_\xi$, $G_\xi$, $B_\xi$) of gradient multicolored pile | | |
|---|---|---|---|---|---|---|
| 1 | $A_1 + A_2 + A_3 + A_4$ | Column A pile | $\frac{3}{6}*C_{A1} + \frac{1}{6}*C_{A2} + \frac{1}{6}*C_{A3} + \frac{1}{6}*C_{A4}$ | 255 | 64 | 0 |
| | | Column B pile | $\frac{2}{6}*C_{A1} + \frac{2}{6}*C_{A2} + \frac{1}{6}*C_{A3} + \frac{1}{6}*C_{A4}$ | 255 | 75 | 0 |
| | | Column C pile | $\frac{1}{6}*C_{A1} + \frac{3}{6}*C_{A2} + \frac{1}{6}*C_{A3} + \frac{1}{6}*C_{A4}$ | 255 | 85 | 0 |
| | | Column D pile | $\frac{1}{6}*C_{A1} + \frac{2}{6}*C_{A2} + \frac{2}{6}*C_{A3} + \frac{1}{6}*C_{A4}$ | 255 | 96 | 0 |
| | | Column E pile | $\frac{1}{6}*C_{A1} + \frac{1}{6}*C_{A2} + \frac{3}{6}*C_{A3} + \frac{1}{6}*C_{A4}$ | 255 | 107 | 0 |
| | | Column F pile | $\frac{1}{6}*C_{A1} + \frac{1}{6}*C_{A2} + \frac{2}{6}*C_{A3} + \frac{2}{6}*C_{A4}$ | 255 | 117 | 0 |
| | | Column G pile | $\frac{1}{6}*C_{A1} + \frac{1}{6}*C_{A2} + \frac{1}{6}*C_{A3} + \frac{3}{6}*C_{A4}$ | 255 | 128 | 0 |
| | | Column H pile | $\frac{2}{6}*C_{A1} + \frac{1}{6}*C_{A2} + \frac{1}{6}*C_{A3} + \frac{2}{6}*C_{A4}$ | 255 | 96 | 0 |
| 2 | $A_2 + A_3 + A_4 + A_5$ | Column A pile | $\frac{3}{6}*C_{A2} + \frac{1}{6}*C_{A3} + \frac{1}{6}*C_{A4} + \frac{1}{6}*C_{A5}$ | 255 | 128 | 0 |
| | | Column B pile | $\frac{2}{6}*C_{A2} + \frac{2}{6}*C_{A3} + \frac{1}{6}*C_{A4} + \frac{1}{6}*C_{A5}$ | 255 | 138 | 0 |
| | | Column C pile | $\frac{1}{6}*C_{A2} + \frac{3}{6}*C_{A3} + \frac{1}{6}*C_{A4} + \frac{1}{6}*C_{A5}$ | 255 | 149 | 0 |
| | | Column D pile | $\frac{1}{6}*C_{A2} + \frac{2}{6}*C_{A3} + \frac{2}{6}*C_{A4} + \frac{1}{6}*C_{A5}$ | 255 | 160 | 0 |
| | | Column E Pile | $\frac{1}{6}*C_{A2} + \frac{1}{6}*C_{A3} + \frac{3}{6}*C_{A4} + \frac{1}{6}*C_{A5}$ | 255 | 170 | 0 |
| | | Column F pile | $\frac{1}{6}*C_{A2} + \frac{1}{6}*C_{A3} + \frac{2}{6}*C_{A4} + \frac{2}{6}*C_{A5}$ | 255 | 181 | 0 |
| | | Column G pile | $\frac{1}{6}*C_{A2} + \frac{1}{6}*C_{A3} + \frac{1}{6}*C_{A4} + \frac{3}{6}*C_{A5}$ | 255 | 191 | 0 |
| | | Column H pile | $\frac{2}{6}*C_{A2} + \frac{1}{6}*C_{A3} + \frac{1}{6}*C_{A4} + \frac{2}{6}*C_{A5}$ | 255 | 160 | 0 |
| 3 | $A_3 + A_4 + A_5 + A_6$ | Column A pile | $\frac{3}{6}*C_{A3} + \frac{1}{6}*C_{A4} + \frac{1}{6}*C_{A5} + \frac{1}{6}*C_{A6}$ | 244 | 181 | 0 |
| | | Column B pile | $\frac{2}{6}*C_{A3} + \frac{2}{6}*C_{A4} + \frac{1}{6}*C_{A5} + \frac{1}{6}*C_{A6}$ | 244 | 191 | 0 |
| | | Column C pile | $\frac{1}{6}*C_{A3} + \frac{3}{6}*C_{A4} + \frac{1}{6}*C_{A5} + \frac{1}{6}*C_{A6}$ | 244 | 202 | 0 |
| | | Column D pile | $\frac{1}{6}*C_{A3} + \frac{2}{6}*C_{A4} + \frac{2}{6}*C_{A5} + \frac{1}{6}*C_{A6}$ | 244 | 213 | 0 |
| | | Column E pile | $\frac{1}{6}*C_{A3} + \frac{1}{6}*C_{A4} + \frac{3}{6}*C_{A5} + \frac{1}{6}*C_{A6}$ | 244 | 223 | 0 |
| | | Column F pile | $\frac{1}{6}*C_{A3} + \frac{1}{6}*C_{A4} + \frac{2}{6}*C_{A5} + \frac{2}{6}*C_{A6}$ | 234 | 223 | 0 |
| | | Column G pile | $\frac{1}{6}*C_{A3} + \frac{1}{6}*C_{A4} + \frac{1}{6}*C_{A5} + \frac{3}{6}*C_{A6}$ | 223 | 223 | 0 |
| | | Column H pile | $\frac{2}{6}*C_{A3} + \frac{1}{6}*C_{A4} + \frac{1}{6}*C_{A5} + \frac{2}{6}*C_{A6}$ | 234 | 202 | 0 |

FIG. 4 shows the application of the RGB values ($R_\xi$,$G_\xi$, $B_\xi$) of the chenille carpet pile ξ corresponding to 6 tufted multicolored filaments, the application of the 24 single-colored filaments, and the design of gradient patterns of color-mixed chenille carpet piles in an embodiment regarding chenille carpet piles with a gradient change in the moderate color mixing effect.

The RGB values of the chenille carpet pile with a moderate color mixing effect are shown in Table 5.

TABLE 5

| SN | Combinations of colors | | Color mixing ratio | RGB values ($R_\xi$, $G_\xi$, $B_\xi$) of gradient multicolored pile | | |
|---|---|---|---|---|---|---|
| 1 | $A_1 + A_2 + A_3 + A_9$ | Column A pile | $\frac{3}{6}*C_{A1} + \frac{1}{6}*C_{A2} + \frac{1}{6}*C_{A3} + \frac{1}{6}*C_{A9}$ | 213 | 75 | 0 |
| | | Column B pile | $\frac{2}{6}*C_{A1} + \frac{2}{6}*C_{A2} + \frac{1}{6}*C_{A3} + \frac{1}{6}*C_{A9}$ | 213 | 80 | 0 |
| | | Column C pile | $\frac{1}{6}*C_{A1} + \frac{3}{6}*C_{A2} + \frac{1}{6}*C_{A3} + \frac{1}{6}*C_{A9}$ | 213 | 96 | 0 |
| | | Column D pile | $\frac{1}{6}*C_{A1} + \frac{2}{6}*C_{A2} + \frac{2}{6}*C_{A3} + \frac{1}{6}*C_{A9}$ | 213 | 107 | 0 |
| | | Column E pile | $\frac{1}{6}*C_{A1} + \frac{1}{6}*C_{A2} + \frac{3}{6}*C_{A3} + \frac{1}{6}*C_{A9}$ | 213 | 117 | 0 |
| | | Column F pile | $\frac{1}{6}*C_{A1} + \frac{1}{6}*C_{A2} + \frac{2}{6}*C_{A3} + \frac{2}{6}*C_{A9}$ | 170 | 138 | 0 |
| | | Column G pile | $\frac{1}{6}*C_{A1} + \frac{1}{6}*C_{A2} + \frac{1}{6}*C_{A3} + \frac{3}{6}*C_{A9}$ | 128 | 160 | 0 |
| | | Column H pile | $\frac{2}{6}*C_{A1} + \frac{1}{6}*C_{A2} + \frac{1}{6}*C_{A3} + \frac{2}{6}*C_{A9}$ | 170 | 117 | 0 |
| 2 | $A_2 + A_3 + A_4 + A_{10}$ | Column A pile | $\frac{3}{6}*C_{A2} + \frac{1}{6}*C_{A3} + \frac{1}{6}*C_{A4} + \frac{1}{6}*C_{A10}$ | 213 | 128 | 11 |
| | | Column B pile | $\frac{2}{6}*C_{A2} + \frac{2}{6}*C_{A3} + \frac{1}{6}*C_{A4} + \frac{1}{6}*C_{A10}$ | 213 | 138 | 11 |
| | | Column C pile | $\frac{1}{6}*C_{A2} + \frac{3}{6}*C_{A3} + \frac{1}{6}*C_{A4} + \frac{1}{6}*C_{A10}$ | 213 | 149 | 11 |
| | | Column D pile | $\frac{1}{6}*C_{A2} + \frac{2}{6}*C_{A3} + \frac{2}{6}*C_{A4} + \frac{1}{6}*C_{A10}$ | 213 | 160 | 11 |
| | | Column E pile | $\frac{1}{6}*C_{A2} + \frac{1}{6}*C_{A3} + \frac{3}{6}*C_{A4} + \frac{1}{6}*C_{A10}$ | 213 | 170 | 11 |
| | | Column F pile | $\frac{1}{6}*C_{A2} + \frac{1}{6}*C_{A3} + \frac{2}{6}*C_{A4} + \frac{2}{6}*C_{A10}$ | 170 | 181 | 22 |
| | | Column G pile | $\frac{1}{6}*C_{A2} + \frac{1}{6}*C_{A3} + \frac{1}{6}*C_{A4} + \frac{3}{6}*C_{A10}$ | 128 | 191 | 33 |
| | | Column H pile | $\frac{2}{6}*C_{A2} + \frac{1}{6}*C_{A3} + \frac{1}{6}*C_{A4} + \frac{2}{6}*C_{A10}$ | 170 | 160 | 22 |
| 3 | $A_3 + A_4 + A_5 + A_{11}$ | Column A pile | $\frac{3}{6}*C_{A3} + \frac{1}{6}*C_{A4} + \frac{1}{6}*C_{A5} + \frac{1}{6}*C_{A11}$ | 213 | 181 | 21 |
| | | Column B pile | $\frac{2}{6}*C_{A3} + \frac{2}{6}*C_{A4} + \frac{1}{6}*C_{A5} + \frac{1}{6}*C_{A11}$ | 213 | 191 | 21 |
| | | Column C pile | $\frac{1}{6}*C_{A3} + \frac{3}{6}*C_{A4} + \frac{1}{6}*C_{A5} + \frac{1}{6}*C_{A11}$ | 213 | 202 | 21 |
| | | Column D pile | $\frac{1}{6}*C_{A3} + \frac{2}{6}*C_{A4} + \frac{2}{6}*C_{A5} + \frac{1}{6}*C_{A11}$ | 213 | 213 | 21 |
| | | Column E pile | $\frac{1}{6}*C_{A3} + \frac{1}{6}*C_{A4} + \frac{3}{6}*C_{A5} + \frac{1}{6}*C_{A11}$ | 213 | 223 | 21 |
| | | Column F pile | $\frac{1}{6}*C_{A3} + \frac{1}{6}*C_{A4} + \frac{2}{6}*C_{A5} + \frac{2}{6}*C_{A11}$ | 170 | 223 | 42 |
| | | Column G pile | $\frac{1}{6}*C_{A3} + \frac{1}{6}*C_{A4} + \frac{1}{6}*C_{A5} + \frac{3}{6}*C_{A11}$ | 128 | 223 | 63 |
| | | Column H pile | $\frac{2}{6}*C_{A3} + \frac{1}{6}*C_{A4} + \frac{1}{6}*C_{A5} + \frac{2}{6}*C_{A11}$ | 170 | 202 | 42 |

FIG. 5 shows the application of the RGB values ($R_\xi$,$G_\xi$,$B_\xi$) of the chenille carpet pile ξ corresponding to 6 tufted multicolored filaments, the application of the 24 single-colored filaments, and the design of gradient patterns of color-mixed chenille carpet piles in an embodiment regarding chenille carpet piles with a gradient change in the clear color mixing effect.

The RGB values of the chenille carpet pile with a clear color mixing effect are shown in Table 6.

TABLE 6

| SN | Combinations of colors | | Color mixing ratio | RGB values ($R_\xi$, $G_\xi$, $B_\xi$) of gradient multicolored pile | | |
|---|---|---|---|---|---|---|
| 1 | $A_1+A_2+A_3+A_{13}$ | Column A pile | $3/6*C_{A1}+1/6*C_{A2}+1/6*C_{A3}+1/6*C_{A13}$ | 213 | 75 | 43 |
| | | Column B pile | $2/6*C_{A1}+2/6*C_{A2}+1/6*C_{A3}+1/6*C_{A13}$ | 213 | 85 | 43 |
| | | Column C pile | $1/6*C_{A1}+3/6*C_{A2}+1/6*C_{A3}+1/6*C_{A13}$ | 213 | 96 | 43 |
| | | Column D pile | $1/6*C_{A1}+2/6*C_{A2}+2/6*C_{A3}+1/6*C_{A13}$ | 213 | 107 | 43 |
| | | Column E pile | $1/6*C_{A1}+1/6*C_{A2}+3/6*C_{A3}+1/6*C_{A13}$ | 213 | 117 | 43 |
| | | Column F pile | $1/6*C_{A1}+1/6*C_{A2}+2/6*C_{A3}+2/6*C_{A13}$ | 170 | 138 | 85 |
| | | Column G pile | $1/6*C_{A1}+1/6*C_{A2}+1/6*C_{A3}+3/6*C_{A13}$ | 128 | 160 | 128 |
| | | Column H pile | $2/6*C_{A1}+1/6*C_{A2}+1/6*C_{A3}+2/6*C_{A13}$ | 170 | 117 | 85 |
| 2 | $A_2+A_3+A_4+A_{14}$ | Column A pile | $3/6*C_{A2}+1/6*C_{A3}+1/6*C_{A4}+1/6*C_{A14}$ | 213 | 117 | 43 |
| | | Column B pile | $2/6*C_{A2}+2/6*C_{A3}+1/6*C_{A4}+1/6*C_{A14}$ | 213 | 128 | 43 |
| | | Column C pile | $1/6*C_{A2}+3/6*C_{A3}+1/6*C_{A4}+1/6*C_{A14}$ | 213 | 138 | 43 |
| | | Column D pile | $1/6*C_{A2}+2/6*C_{A3}+2/6*C_{A4}+1/6*C_{A14}$ | 213 | 149 | 43 |
| | | Column E pile | $1/6*C_{A2}+1/6*C_{A3}+3/6*C_{A4}+1/6*C_{A14}$ | 213 | 159 | 43 |
| | | Column F pile | $1/6*C_{A2}+1/6*C_{A3}+2/6*C_{A4}+2/6*C_{A14}$ | 170 | 159 | 85 |
| | | Column G pile | $1/6*C_{A2}+1/6*C_{A3}+1/6*C_{A4}+3/6*C_{A14}$ | 128 | 159 | 128 |
| | | Column H pile | $2/6*C_{A2}+1/6*C_{A3}+1/6*C_{A4}+2/6*C_{A14}$ | 170 | 138 | 85 |
| 3 | $A_3+A_4+A_5+A_{15}$ | Column A pile | $3/6*C_{A3}+1/6*C_{A4}+1/6*C_{A5}+1/6*C_{A15}$ | 213 | 160 | 43 |
| | | Column B pile | $2/6*C_{A3}+2/6*C_{A4}+1/6*C_{A5}+1/6*C_{A15}$ | 213 | 170 | 43 |
| | | Column C pile | $1/6*C_{A3}+3/6*C_{A4}+1/6*C_{A5}+1/6*C_{A15}$ | 213 | 181 | 43 |
| | | Column D pile | $1/6*C_{A3}+2/6*C_{A4}+2/6*C_{A5}+1/6*C_{A15}$ | 213 | 191 | 43 |
| | | Column E pile | $1/6*C_{A3}+1/6*C_{A4}+3/6*C_{A5}+1/6*C_{A15}$ | 213 | 202 | 43 |
| | | Column F pile | $1/6*C_{A3}+1/6*C_{A4}+2/6*C_{A5}+2/6*C_{A15}$ | 170 | 181 | 85 |
| | | Column G pile | $1/6*C_{A3}+1/6*C_{A4}+1/6*C_{A5}+3/6*C_{A15}$ | 128 | 160 | 128 |
| | | Column H pile | $2/6*C_{A3}+1/6*C_{A4}+1/6*C_{A5}+2/6*C_{A15}$ | 170 | 160 | 85 |

In the above technical solutions, the present disclosure regulates the uneven distribution of the multicolored filaments on the chenille carpet pile by changing the combination modes and ratios of the multicolored filaments, thereby producing patterns with hazy, moderate and clear color mixing effects. Different from the additive mixing of color light and the subtractive mixing of pigments, the mixing of single-colored filaments is spatial juxtaposition mixing and. non-uniform mixing. The present disclosure regulates the mixing ratio of the single-colored filaments and the hue, luminance and saturation differences between the single-colored filaments, such that the chenille pile can visually present hazy, moderate and clear color mixing effects. The entire design implementation of the present disclosure can effectively improve the efficiency of constructing the pattern of the chenille carpet pile.

Although the embodiments of the present disclosure are described in detail above in conjunction with the drawings, the present disclosure is not limited to the above-described embodiments, and various changes may be made without departing from the spirit of the present disclosure within the knowledge of those skilled in the art.

What is claimed is:

1. A construction method of a pattern for a chenille carpet pile, based on a quaternary colors mixing regulation of multicolored filaments comprising the following steps:

step A: constructing a quaternary multicolored filament system by mixing four types of single-colored filaments based on a preset number of single-colored filaments to form the multicolored filaments; and proceeding to step B;

step B: spinning and tufting four types of multicolored filaments α,β,γ,δ in the quaternary multicolored filament system to obtain a chenille carpet pile ξ; based on red, green, and blue (RGB) values ($R_\alpha$,$G_\alpha$,$B_\alpha$), ($R_\beta$,$G_\beta$,$B_\beta$), ($R_\gamma$,$G_\gamma$,$B_\gamma$), and ($R_\delta$,$G_\delta$,$B_\delta$) of the four types of the multicolored filaments α,β,γ,δ, calculating RGB values ($R_\xi$,$G_\xi$,$B_\xi$) of the chenille carpet pile ξ corresponding to a specified number of tufted multicolored filaments; and proceeding to step C; and step C: selecting combinations of the four types of the single-colored filaments with a preset hue difference from the preset number of the single-colored filaments to form multiple types of the multicolored filaments with the preset hue difference; and according to the RGB values ($R_\xi$,$G_\xi$,$B_\xi$) of the chenille carpet pile ξ corresponding to the specified number of the tufted multicolored filaments, spinning and tufting four types of the multicolored filaments based on the multiple types of the multicolored filaments with the preset hue difference to respectively construct preset types of chenille carpet pile;

selecting combinations of four types of single-colored filaments with a hue difference of less than 60° from the preset number of single-colored filaments to form multiple types of the multicolored filaments with the hue difference of less than 60°; and according to the RGB values ($R_\xi$,$G_\xi$,$B_\xi$) of the chenille carpet pile ξ corresponding to the specified number of tufted multicolored filaments, spinning and tufting four types of the multicolored filaments based on the multiple types of the multicolored filaments with the hue difference of less than 60° to construct a chenille carpet pile with a hazy color mixing effect;

selecting combinations of four types of single-colored filaments with a hue difference of greater than 60° and less than 120° from the preset number of single-colored filaments to form multiple types of the multicolored filaments with the hue difference of greater than 60° and less than 120°; and according to the RGB values ($R_\xi$,$G_\xi$,$B_\xi$) of the chenille carpet pile ξ corresponding to the specified number of tufted multicolored filaments, spinning and tufting four types of the multicolored filaments based on the multiple types of the multicolored filaments with the hue difference of greater than 60° and less than 120° to construct a chenille carpet pile with a moderate color mixing effect; and selecting combinations of four types of single-colored filaments with a hue difference of greater than 120° and less than 180° from the preset number of single-colored filaments, and selecting combinations of three types of single-colored filaments with the hue difference of greater than 120° and less than 180° from the preset number of single-colored filaments to cooperate with a white or black filament to form combinations of four types of single-colored filaments; forming multiple types of the multicolored filaments with the hue difference of greater than 120° and less than 180°; and according to the RGB values ($R_\xi$,$G_\xi$,$B_\xi$) of the chenille carpet pile ξ corresponding to the specified number of tufted multicolored filaments, spinning and tufting four types of the multicolored filaments based on the multiple types of the multicolored filaments with the hue difference of greater than 120° and less than 180° to construct a chenille carpet pile with a clear color mixing effect.

2. The construction method of the pattern for the chenille carpet pile based on the quaternary colors mixing regulation of the multicolored filaments according to claim 1, wherein the step B comprises: based on Table 1,

TABLE 1

| Combinations | RGB values after combination | | |
|---|---|---|---|
| | $R_\xi$ | $G_\xi$ | $B_\xi$ |
| 4α | $R_\alpha$ | $G_\alpha$ | $B_\alpha$ |
| 3α + 1β | $\frac{3}{4}*R_\alpha+\frac{1}{4}*R_\beta$ | $\frac{3}{4}*G_\alpha+\frac{1}{4}*G_\beta$ | $\frac{3}{4}*B_\alpha+\frac{1}{4}*B_\beta$ |
| 2α + 1β + 1γ | $\frac{2}{4}*R_\alpha+\frac{1}{4}*R_\beta+\frac{1}{4}*R_\gamma$ | $\frac{2}{4}*G_\alpha+\frac{1}{4}*G_\beta+\frac{1}{4}*G_\gamma$ | $\frac{2}{4}*B_\alpha+\frac{1}{4}*B_\beta+\frac{1}{4}*B_\gamma$ |
| 1α + 1β + 1γ + 1δ | $\frac{1}{4}*R_\alpha+\frac{1}{4}*R_\beta+\frac{1}{4}*R_\gamma+\frac{1}{4}*R_\delta$ | $\frac{1}{4}*G_\alpha+\frac{1}{4}*G_\beta+\frac{1}{4}*G_\gamma+\frac{1}{4}*G_\delta$ | $\frac{1}{4}*B_\alpha+\frac{1}{4}*B_\beta+\frac{1}{4}*B_\gamma+\frac{1}{4}*B_\delta$ |
| 2β + 1γ + 1δ | $\frac{2}{4}*R_\beta+\frac{1}{4}*R_\gamma+\frac{1}{4}*R_\delta$ | $\frac{2}{4}*G_\beta+\frac{1}{4}*G_\gamma+\frac{1}{4}*G_\delta$ | $\frac{2}{4}*B_\beta+\frac{1}{4}*B_\gamma+\frac{1}{4}*B_\delta$ |
| 3β + 1γ | $\frac{3}{4}*R_\beta+\frac{1}{4}*R_\gamma$ | $\frac{3}{4}*G_\beta+\frac{1}{4}*G_\gamma$ | $\frac{3}{4}*G_\beta+\frac{1}{4}*G_\gamma$ |
| 4β | $R_\beta$ | $G_\beta$ | $B_\beta$ |
| 1α + 1β + 1γ + 1δ | $\frac{1}{4}*R_\alpha+\frac{1}{4}*R_\beta+\frac{1}{4}*R_\gamma+\frac{1}{4}*R_\delta$ | $\frac{1}{4}*G_\alpha+\frac{1}{4}*G_\beta+\frac{1}{4}*G_\gamma+\frac{1}{4}*G_\delta$ | $\frac{1}{4}*B_\alpha+\frac{1}{4}*B_\beta+\frac{1}{4}*B_\gamma+\frac{1}{4}*B_\delta$ |
| 1β + 2γ + 1δ | $\frac{1}{4}*R_\beta+\frac{2}{4}*R_\gamma+\frac{1}{4}*R_\delta$ | $\frac{1}{4}*G_\beta+\frac{2}{4}*G_\gamma+\frac{1}{4}*G_\delta$ | $\frac{1}{4}*B_\beta+\frac{2}{4}*B_\gamma+\frac{1}{4}*B_\delta$ |
| 3γ + 1δ | $\frac{3}{4}*R_\gamma+\frac{1}{4}*R_\delta$ | $\frac{3}{4}*G_\gamma+\frac{1}{4}*G_\delta$ | $\frac{3}{4}*B_\gamma+\frac{1}{4}*B_\delta$ |
| 4γ | $R_\gamma$ | $G_\gamma$ | $B_\gamma$ |
| 1α + 2γ + 1δ | $\frac{1}{4}*R_\alpha+\frac{2}{4}*R_\gamma+\frac{1}{4}*R_\delta$ | $\frac{1}{4}*G_\alpha+\frac{2}{4}*G_\gamma+\frac{1}{4}*G_\delta$ | $\frac{1}{4}*B_\alpha+\frac{2}{4}*B_\gamma+\frac{1}{4}*B_\delta$ |
| 1α + 1γ + 1δ | $\frac{1}{4}*R_\alpha+\frac{1}{4}*R_\beta+\frac{1}{4}*R_\gamma+\frac{1}{4}*R_\delta$ | $\frac{1}{4}*G_\alpha+\frac{1}{4}*G_\beta+\frac{1}{4}*G_\gamma+\frac{1}{4}*G_\delta$ | $\frac{1}{4}*B_\alpha+\frac{1}{4}*B_\beta+\frac{1}{4}*B_\gamma+\frac{1}{4}*B_\delta$ |
| 1α + 3δ | $\frac{1}{4}*R_\alpha+\frac{3}{4}*R_\delta$ | $\frac{1}{4}*G_\alpha+\frac{3}{4}*G_\delta$ | $\frac{1}{4}*B_\alpha+\frac{3}{4}*B_\delta$ |
| 4δ | $R_\delta$ | $G_\delta$ | $B_\delta$ |
| 1α + 1β + 2δ | $\frac{1}{4}*R_\alpha+\frac{1}{4}*R_\beta+\frac{2}{4}*R_\delta$ | $\frac{1}{4}*G_\alpha+\frac{1}{4}*G_\beta+\frac{2}{4}*G_\delta$ | $\frac{1}{4}*B_\alpha+\frac{1}{4}*B_\beta+\frac{2}{4}*B_\delta$ |
| 1α + 1β + 1γ + 1δ | $\frac{1}{4}*R_\alpha+\frac{1}{4}*R_\beta+\frac{1}{4}*R_\gamma+\frac{1}{4}*R_\delta$ | $\frac{1}{4}*G_\alpha+\frac{1}{4}*G_\beta+\frac{1}{4}*G_\gamma+\frac{1}{4}*G_\delta$ | $\frac{1}{4}*B_\alpha+\frac{1}{4}*B_\beta+\frac{1}{4}*B_\gamma+\frac{1}{4}*B_\delta$ |

calculating the RGB values ($R_\xi$,$G_\xi$,$B_\xi$) of the chenille carpet pile ξ corresponding to four tufted multicolored filaments.

3. The construction method of the pattern for the chenille carpet pile based on the quaternary colors mixing regulation of the multicolored filaments according to claim 1, wherein the step B comprises: based on Table 2, calculating the RGB values ($R_\xi$,$G_\xi$,$B_\xi$) of the chenille carpet pile ξ corresponding to six tufted multicolored filaments.

4. The construction method of the pattern for the chenille carpet pile based on the quaternary colors mixing regulation of the multicolored filaments according to claim 1, wherein the step B comprises: based on Table 3,

TABLE 2

| | RGB values after combination | | |
|---|---|---|---|
| Combinations | $R_\xi$ | $G_\xi$ | $B_\xi$ |
| 6α | $R_\alpha$ | $G_\alpha$ | $B_\alpha$ |
| 5α + 1β | $\frac{5}{6}*R_\alpha+\frac{1}{6}*R_\beta$ | $\frac{5}{6}*G_\alpha+\frac{1}{6}*G_\beta$ | $\frac{5}{6}*B_\alpha+\frac{1}{6}*B_\beta$ |
| 4α + 1β + 1γ | $\frac{4}{6}*R_\alpha+\frac{1}{6}*R_\beta+\frac{1}{6}*R_\gamma$ | $\frac{4}{6}*G_\alpha+\frac{1}{6}*G_\beta+\frac{1}{6}*G_\gamma$ | $\frac{4}{6}*B_\alpha+\frac{1}{6}*B_\beta+\frac{1}{6}*B_\gamma$ |
| 3α + 1β + 1γ + 1δ | $\frac{3}{6}*R_\alpha+\frac{1}{6}*R_\beta+\frac{1}{6}*R_\gamma+\frac{1}{6}*R_\delta$ | $\frac{3}{6}*G_\alpha+\frac{1}{6}*G_\beta+\frac{1}{6}*G_\gamma+\frac{1}{6}*G_\delta$ | $\frac{3}{6}*B_\alpha+\frac{1}{6}*B_\beta+\frac{1}{6}*B_\gamma+\frac{1}{6}*B_\delta$ |
| 2α + 2β + 1γ + 1δ | $\frac{2}{6}*R_\alpha+\frac{2}{6}*R_\beta+\frac{1}{6}*R_\gamma+\frac{1}{6}*R_\delta$ | $\frac{2}{6}*G_\alpha+\frac{2}{6}*G_\beta+\frac{1}{6}*G_\gamma+\frac{1}{6}*G_\delta$ | $\frac{2}{6}*B_\alpha+\frac{2}{6}*B_\beta+\frac{1}{6}*B_\gamma+\frac{1}{6}*B_\delta$ |
| 1α + 3β + 1γ + 1δ | $\frac{1}{6}*R_\alpha+\frac{3}{6}*R_\beta+\frac{1}{6}*R_\gamma+\frac{1}{6}*R_\delta$ | $\frac{1}{6}*G_\alpha+\frac{3}{6}*G_\beta+\frac{1}{6}*G_\gamma+\frac{1}{6}*G_\delta$ | $\frac{1}{6}*B_\alpha+\frac{3}{6}*B_\beta+\frac{1}{6}*B_\gamma+\frac{1}{6}*B_\delta$ |
| 4β + 1γ + 1δ | $\frac{4}{6}*R_\beta+\frac{1}{6}*R_\gamma+\frac{1}{6}*R_\delta$ | $\frac{4}{6}*G_\beta+\frac{1}{6}*G_\gamma+\frac{1}{6}*G_\delta$ | $\frac{4}{6}*B_\beta+\frac{1}{6}*B_\gamma+\frac{1}{6}*B_\delta$ |
| 5β + 1γ | $\frac{5}{6}*R_\beta+\frac{1}{6}*R_\gamma$ | $\frac{5}{6}*G_\beta+\frac{1}{6}*G_\gamma$ | $\frac{5}{6}*B_\beta+\frac{1}{6}*B_\gamma$ |
| 6β | $R_\beta$ | $G_\beta$ | $B_\beta$ |
| 1α + 2β + 2γ + 1δ | $\frac{1}{6}*R_\alpha+\frac{2}{6}*R_\beta+\frac{2}{6}*R_\gamma+\frac{1}{6}*R_\delta$ | $\frac{1}{6}*G_\alpha+\frac{2}{6}*G_\beta+\frac{2}{6}*G_\gamma+\frac{1}{6}*G_\delta$ | $\frac{1}{6}*B_\alpha+\frac{2}{6}*B_\beta+\frac{2}{6}*B_\gamma+\frac{1}{6}*B_\delta$ |
| 1α + 1β + 3γ + 1δ | $\frac{1}{6}*R_\alpha+\frac{1}{6}*R_\beta+\frac{3}{6}*R_\gamma+\frac{1}{6}*R_\delta$ | $\frac{1}{6}*G_\alpha+\frac{1}{6}*G_\beta+\frac{3}{6}*G_\gamma+\frac{1}{6}*G_\delta$ | $\frac{1}{6}*B_\alpha+\frac{1}{6}*B_\beta+\frac{3}{6}*B_\gamma+\frac{1}{6}*B_\delta$ |
| 1β + 4γ + 1δ | $\frac{1}{6}*R_\beta+\frac{4}{6}*R_\gamma+\frac{1}{6}*R_\delta$ | $\frac{1}{6}*G_\beta+\frac{4}{6}*G_\gamma+\frac{1}{6}*G_\delta$ | $\frac{1}{6}*B_\beta+\frac{4}{6}*B_\gamma+\frac{1}{6}*B_\delta$ |
| 5γ + 1δ | $\frac{5}{6}*R_\gamma+\frac{1}{6}*R_\delta$ | $\frac{5}{6}*G_\gamma+\frac{1}{6}*G_\delta$ | $\frac{5}{6}*B_\gamma+\frac{1}{6}*B_\delta$ |
| 6γ | $R_\gamma$ | $G_\gamma$ | $B_\gamma$ |
| 1α + 1β + 2γ + 2δ | $\frac{1}{6}*R_\alpha+\frac{1}{6}*R_\beta+\frac{2}{6}*R_\gamma+\frac{2}{6}*R_\delta$ | $\frac{1}{6}*G_\alpha+\frac{1}{6}*G_\beta+\frac{2}{6}*G_\gamma+\frac{2}{6}*G_\delta$ | $\frac{1}{6}*B_\alpha+\frac{1}{6}*B_\beta+\frac{2}{6}*B_\gamma+\frac{2}{6}*B_\delta$ |
| 1α + 1β + 1γ + 3δ | $\frac{1}{6}*R_\alpha+\frac{1}{6}*R_\beta+\frac{1}{6}*R_\gamma+\frac{3}{6}*R_\delta$ | $\frac{1}{6}*G_\alpha+\frac{1}{6}*G_\beta+\frac{1}{6}*G_\gamma+\frac{3}{6}*G_\delta$ | $\frac{1}{6}*B_\alpha+\frac{1}{6}*B_\beta+\frac{1}{6}*B_\gamma+\frac{3}{6}*B_\delta$ |
| 1α + 1β + 4δ | $\frac{1}{6}*R_\alpha+\frac{1}{6}*R_\beta+\frac{4}{6}*R_\delta$ | $\frac{1}{6}*G_\alpha+\frac{1}{6}*G_\beta+\frac{4}{6}*G_\delta$ | $\frac{1}{6}*B_\alpha+\frac{1}{6}*B_\beta+\frac{4}{6}*B_\delta$ |
| 1α + 5δ | $\frac{1}{6}*R_\alpha+\frac{5}{6}*R_\delta$ | $\frac{1}{6}*G_\alpha+\frac{5}{6}*G_\delta$ | $\frac{1}{6}*B_\alpha+\frac{5}{6}*B_\delta$ |
| 6δ | $R_\delta$ | $G_\delta$ | $B_\delta$ |
| 2α + 1β + 1γ + 2δ | $\frac{2}{6}*R_\alpha+\frac{1}{6}*R_\beta+\frac{1}{6}*R_\gamma+\frac{2}{6}*R_\delta$ | $\frac{2}{6}*G_\alpha+\frac{1}{6}*G_\beta+\frac{1}{6}*G_\gamma+\frac{2}{6}*G_\delta$ | $\frac{2}{6}*B_\alpha+\frac{1}{6}*B_\beta+\frac{1}{6}*B_\gamma+\frac{2}{6}*B_\delta$ |

TABLE 3

| Combination | RGB values after combination | | |
|---|---|---|---|
| | $R_\xi$ | $G_\xi$ | $B_\xi$ |
| 6α | $R_\alpha$ | $G_\alpha$ | $B_\alpha$ |
| 5α + 1β | $\frac{5}{6}*R_\alpha+\frac{1}{6}*R_\beta$ | $\frac{5}{6}*G_\alpha+\frac{1}{6}*G_\beta$ | $\frac{5}{6}*B_\alpha+\frac{1}{6}*B_\beta$ |
| 4α + 1β + 1γ | $\frac{4}{6}*R_\alpha+\frac{1}{6}*R_\beta+\frac{1}{6}*R_\gamma$ | $\frac{4}{6}*G_\alpha+\frac{1}{6}*G_\beta+\frac{1}{6}*G_\gamma$ | $\frac{4}{6}*B_\alpha+\frac{1}{6}*B_\beta+\frac{1}{6}*B_\gamma$ |
| 3α + 1β + 1γ + 1δ | $\frac{3}{6}*R_\alpha+\frac{1}{6}*R_\beta+\frac{1}{6}*R_\gamma+\frac{1}{6}*R_\delta$ | $\frac{3}{6}*G_\alpha+\frac{1}{6}*G_\beta+\frac{1}{6}*G_\gamma+\frac{1}{6}*G_\delta$ | $\frac{3}{6}*B_\alpha+\frac{1}{6}*B_\beta+\frac{1}{6}*B_\gamma+\frac{1}{6}*B_\delta$ |
| 2α + 2β + 1γ + 1δ | $\frac{2}{6}*R_\alpha+\frac{2}{6}*R_\beta+\frac{1}{6}*R_\gamma+\frac{1}{6}*R_\delta$ | $\frac{2}{6}*G_\alpha+\frac{2}{6}*G_\beta+\frac{1}{6}*G_\gamma+\frac{1}{6}*G_\delta$ | $\frac{2}{6}*B_\alpha+\frac{2}{6}*B_\beta+\frac{1}{6}*B_\gamma+\frac{1}{6}*B_\delta$ |
| 1α + 3β + 1γ + 1δ | $\frac{1}{6}*R_\alpha+\frac{3}{6}*R_\beta+\frac{1}{6}*R_\gamma+\frac{1}{6}*R_\delta$ | $\frac{1}{6}*G_\alpha+\frac{3}{6}*G_\beta+\frac{1}{6}*G_\gamma+\frac{1}{6}*G_\delta$ | $\frac{1}{6}*B_\alpha+\frac{3}{6}*B_\beta+\frac{1}{6}*B_\gamma+\frac{1}{6}*B_\delta$ |
| 4β + 1γ + 1δ | $\frac{4}{6}*R_\beta+\frac{1}{6}*R_\gamma+\frac{1}{6}*R_\delta$ | $\frac{4}{6}*G_\beta+\frac{1}{6}*G_\gamma+\frac{1}{6}*G_\delta$ | $\frac{4}{6}*B_\beta+\frac{1}{6}*B_\gamma+\frac{1}{6}*B_\delta$ |
| 5β + 1γ | $\frac{5}{6}*R_\beta+\frac{1}{6}*R_\gamma$ | $\frac{5}{6}*G_\beta+\frac{1}{6}*G_\gamma$ | $\frac{5}{6}*B_\beta+\frac{1}{6}*B_\gamma$ |
| 6β | $R_\beta$ | $G_\beta$ | $B_\beta$ |
| 1α + 2β + 2γ + 1δ | $\frac{1}{6}*R_\alpha+\frac{2}{6}*R_\beta+\frac{2}{6}*R_\gamma+\frac{1}{6}*R_\delta$ | $\frac{1}{6}*G_\alpha+\frac{2}{6}*G_\beta+\frac{2}{6}*G_\gamma+\frac{1}{6}*G_\delta$ | $\frac{1}{6}*B_\alpha+\frac{2}{6}*B_\beta+\frac{2}{6}*B_\gamma+\frac{1}{6}*B_\delta$ |
| 1α + 1β + 3γ + 1δ | $\frac{1}{6}*R_\alpha+\frac{1}{6}*R_\beta+\frac{3}{6}*R_\gamma+\frac{1}{6}*R_\delta$ | $\frac{1}{6}*G_\alpha+\frac{1}{6}*G_\beta+\frac{3}{6}*G_\gamma+\frac{1}{6}*G_\delta$ | $\frac{1}{6}*B_\alpha+\frac{1}{6}*B_\beta+\frac{3}{6}*B_\gamma+\frac{1}{6}*B_\delta$ |
| 1β + 4γ + 1δ | $\frac{1}{6}*R_\beta+\frac{4}{6}*R_\gamma+\frac{1}{6}*R_\delta$ | $\frac{1}{6}*G_\beta+\frac{4}{6}*G_\gamma+\frac{1}{6}*G_\delta$ | $\frac{1}{6}*B_\beta+\frac{4}{6}*B_\gamma+\frac{1}{6}*B_\delta$ |
| 5γ + 1δ | $\frac{5}{6}*R_\gamma+\frac{1}{6}*R_\delta$ | $\frac{5}{6}*G_\gamma+\frac{1}{6}*G_\delta$ | $\frac{5}{6}*B_\gamma+\frac{1}{6}*B_\delta$ |
| 6γ | $R_\gamma$ | $G_\gamma$ | $B_\gamma$ |
| 1α + 1β + 2γ + 2δ | $\frac{1}{6}*R_\alpha+\frac{1}{6}*R_\beta+\frac{2}{6}*R_\gamma+\frac{2}{6}*R_\delta$ | $\frac{1}{6}*G_\alpha+\frac{1}{6}*G_\beta+\frac{2}{6}*G_\gamma+\frac{2}{6}*G_\delta$ | $\frac{1}{6}*B_\alpha+\frac{1}{6}*B_\beta+\frac{2}{6}*B_\gamma+\frac{2}{6}*B_\delta$ |
| 1α + 1β + 1γ + 3δ | $\frac{1}{6}*R_\alpha+\frac{1}{6}*R_\beta+\frac{1}{6}*R_\gamma+\frac{3}{6}*R_\delta$ | $\frac{1}{6}*G_\alpha+\frac{1}{6}*G_\beta+\frac{1}{6}*G_\gamma+\frac{3}{6}*G_\delta$ | $\frac{1}{6}*B_\alpha+\frac{1}{6}*B_\beta+\frac{1}{6}*B_\gamma+\frac{3}{6}*B_\delta$ |
| 1α + 1β + 4δ | $\frac{1}{6}*R_\alpha+\frac{1}{6}*R_\beta+\frac{4}{6}*R_\delta$ | $\frac{1}{6}*G_\alpha+\frac{1}{6}*G_\beta+\frac{4}{6}*G_\delta$ | $\frac{1}{6}*B_\alpha+\frac{1}{6}*B_\beta+\frac{4}{6}*B_\delta$ |
| 1α + 5δ | $\frac{1}{6}*R_\alpha+\frac{5}{6}*R_\delta$ | $\frac{1}{6}*G_\alpha+\frac{5}{6}*G_\delta$ | $\frac{1}{6}*B_\alpha+\frac{5}{6}*B_\delta$ |
| 6δ | $R_\delta$ | $G_\delta$ | $B_\delta$ |
| 2α + 1β + 1γ + 2δ | $\frac{2}{6}*R_\alpha+\frac{1}{6}*R_\beta+\frac{1}{6}*R_\gamma+\frac{2}{6}*R_\delta$ | $\frac{2}{6}*G_\alpha+\frac{1}{6}*G_\beta+\frac{1}{6}*G_\gamma+\frac{2}{6}*G_\delta$ | $\frac{2}{6}*B_\alpha+\frac{1}{6}*B_\beta+\frac{1}{6}*B_\gamma+\frac{2}{6}*B_\delta$ |

calculating the RGB values ($R_\xi$,$G_\xi$,$B_\xi$) of the chenille carpet pile ξ corresponding to eight tufted multicolored filaments.

* * * * *